US009305570B2

(12) United States Patent
Visser et al.

(10) Patent No.: US 9,305,570 B2
(45) Date of Patent: Apr. 5, 2016

(54) SYSTEMS, METHODS, APPARATUS, AND COMPUTER-READABLE MEDIA FOR PITCH TRAJECTORY ANALYSIS

(71) Applicant: QUALCOMM Incorporated, San Diego, CA (US)

(72) Inventors: Erik Visser, San Diego, CA (US); Yinyi Guo, San Diego, CA (US); Lae-Hoon Kim, San Diego, CA (US); Pei Xiang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 546 days.

(21) Appl. No.: 13/840,863

(22) Filed: Mar. 15, 2013

(65) Prior Publication Data

US 2013/0339011 A1 Dec. 19, 2013

Related U.S. Application Data

(60) Provisional application No. 61/659,171, filed on Jun. 13, 2012.

(51) Int. Cl.

| | |
|---|---|
| ***G10L 21/00*** | (2013.01) |
| ***G10L 25/93*** | (2013.01) |
| ***G10L 25/90*** | (2013.01) |
| ***G10L 21/02*** | (2013.01) |
| ***G10H 1/00*** | (2006.01) |
| ***G10H 1/36*** | (2006.01) |

(52) U.S. Cl.

CPC ..... *G10L 25/90* (2013.01); *G10H 1/0008* (2013.01); *G10H 1/361* (2013.01); *G10H 2210/056* (2013.01); *G10H 2210/066* (2013.01); *G10H 2210/211* (2013.01); *G10H 2250/131* (2013.01); *G10H 2250/215* (2013.01); *G10H 2250/225* (2013.01); *G10H 2250/251* (2013.01)

(58) Field of Classification Search

USPC ..... 704/205–208, 226, 233

See application file for complete search history.

(56) References Cited

U.S. PATENT DOCUMENTS

| | | | | |
|---|---|---|---|---|
| 6,549,767 | B1 * | 4/2003 | Kawashima | H04M 1/72547 455/412.2 |
| 7,415,392 | B2 * | 8/2008 | Smaragdis | G10L 21/0272 375/240.12 |
| 7,636,659 | B1 | 12/2009 | Athineos et al. | |
| 2005/0065781 | A1 | 3/2005 | Tell et al. | |
| 2008/0097754 | A1 * | 4/2008 | Goto | G10L 15/26 704/214 |

(Continued)

FOREIGN PATENT DOCUMENTS

| | | | |
|---|---|---|---|
| EP | 1918911 | A1 | 5/2008 |
| WO | 2010140166 | A2 | 12/2010 |

OTHER PUBLICATIONS

Goodwin, "Frequency-Domain Algorithms for Audio Signal Enhancement Based on Transient Modification," 2006, AES Journal, vol. 54, No. 9, pp. 1-14, 2006.*

(Continued)

*Primary Examiner* — Olujimi Adesanya

(74) *Attorney, Agent, or Firm* — Austin Rapp & Hardman

(57) ABSTRACT

Systems, methods, and apparatus for pitch trajectory analysis are described. Such techniques may be used to remove vocals and/or vibrato from an audio mixture signal. For example, such a technique may be used to pre-process the signal before an operation to decompose the mixture signal into individual instrument components.

40 Claims, 32 Drawing Sheets

(56) References Cited

U.S. PATENT DOCUMENTS

| | | | | |
|---|---|---|---|---|
| 2009/0119097 | A1 | 5/2009 | Master et al. | |
| 2009/0132077 | A1* | 5/2009 | Fujihara | G06F 17/30743 700/94 |
| 2010/0131086 | A1* | 5/2010 | Itoyama | G10H 1/0008 700/94 |
| 2011/0054910 | A1* | 3/2011 | Fujihara | G10L 15/265 704/278 |
| 2011/0282658 | A1* | 11/2011 | Wang | G10L 21/0272 704/208 |
| 2012/0101826 | A1 | 4/2012 | Visser et al. | |
| 2012/0128165 | A1 | 5/2012 | Visser et al. | |
| 2013/0064379 | A1* | 3/2013 | Pardo | H04S 7/40 381/56 |

OTHER PUBLICATIONS

Rahimzadeh, "Detection of Singing Voice Signals in Popular Music Recordings," 2009, Diploma Thesis IEM, pp. 1-79, Nov. 2009.*

Vembu et al, "Separation of Vocals From Polyphonic Audio Recordings,"2005, Proc. ISMIR, pp. 337-344, Nov. 2005.*

FitzGerald et al. "Single Channel Vocal Separation using Median Filtering and Factorisation Techniques," 2010, ISAST Transactions on Electronic and Signal Processing, 4(1):62-73, 2010.*

Li, and D.Wang: "Separation of singing voice from music accompaniment for monaural recordings," 2007, Proc. of ICASSP, 15(4):1475:1487, May 2007.*

Wang et al, "Musical audio stream separation by non-negative matrix factorization", 2005, in: Proceedings of the DMRN Summer Conference. (2005), pp. 1-5.*

Chanrungutai et al, "Singing voice separation for mono-channel music using Non-negative Matrix Factorization," 2008, in Advanced Technologies for Communications, 2008. ATC 2008. International Conference on , vol., No., pp. 243-246, Oct. 6-9, 2008.*

Every, "Discriminating Between Pitched Sources in Music Audio," 2008, in Audio, Speech, and Language Processing, IEEE Transactions on , vol. 16, No. 2, pp. 267-277, Feb. 2008.*

Duan et al, "Unsupervised Single-Channel Music Source Separation by Average Harmonic Structure Modeling," 2008, in Audio, Speech, and Language Processing, IEEE Transactions on , vol. 16, No. 4, pp. 766-778, May 2008.*

Rao, et al, "Vocal Melody Extraction in the Presence of Pitched Accompaniment in Polyphonic Music," Nov. 2010, in Audio, Speech, and Language Processing, IEEE Transactions on , vol. 18, No. 8, pp. 2145-2154, Nov. 2010.*

Amir et al, "Automated evaluation of singers' vibrato through time and frequency analysis of the pitch contour using the DSK6713," Jul. 2009, in Digital Signal Processing, 2009 16th International Conference on , vol., No., pp. 1-5.*

Sofianos et al, "Singing Voice Separation Based on Non-Vocal Independent Component Subtraction and Amplitude Discrimination", 2010, in: Proceedings of the 13th International Conference on Digital Audio Effects, pp. 1-4.*

Virtanen, "Monaural Sound Source Separation by Nonnegative Matrix Factorization With Temporal Continuity and Sparseness Criteria,", Mar. 2007, in Audio, Speech, and Language Processing, IEEE Transactions, vol. 15, No. 3, pp. 1066-1074.*

Ewert S., "Score-informed Source Separation for Music Signals", Multimodal Music Processing, Apr. 27, 2012, pp. 73-94, XP055067329, Schloss Dagstuhl—Leibniz—Zentrum fur Informatik, Germany, DOI: 10.4230/DRU.Vol3.11041.73, ISBN: 978-3-93-989737-8, Joint use of instrument/vocal discrimination by vibrato detection (p. 74 and reference [40] Regnier and Peeters) and non-negative matrix factorization (NMF); pp. 75,78-87; figures 5-10.

Fletcher, N. "Vibrato in Music," Acoustics Australia, vol. 29 (2001), No. 3, pp. 97-102. Accessed online Apr. 2, 2013 at www.phys.unsw.edu.au/music/people/publications/Fletcher2001a.pdf.

Hsu, C.L., et al., "Singing Pitch Extraction by Voice Vibrato/Tremolo Estimation and Instrument Partial Deletion," 11th International Society for Music Information Retrieval Conference (ISMIR 2010), pp. 525-530. Accessed online Apr. 2, 2013 at ismir2010.ismir.net/proceedings/ismir2010-89.pdf.

International Search Report and Written Opinion—PCT/US2013/032780-ISA/EPO—Jul. 9, 2013.

Lagrange, M., et al., "Enhancing the Tracking of Partials for the Sinusoidal Modeling of Polyphonic Sounds," IEEE Trans. ASLP, vol. 15, No. 5, Jul. 2007, pp. 1625-1634.

Regnier, L., et al., "Singing Voice Detection in Music Tracks Using Direct Voice Vibrato Detection," Acoustics, Speech and Signal Processing, 2009. ICASSP 2009. IEEE International Conference on, Apr. 19-24, 2009, pp. 1685-1688.

Rieck S., "Singing Voice Extraction from 2-Channel Polyphonic Musical Recordings", Diploma Thesis, May 7, 2012, pp. 1-86, XP055067280, Tu Graz, Austria, Motivation stated on p. 1 last sentence: Voice/instrument discrimination method, Singing voice attenuation, also based on vibrato depth (see pp. 3,26 and reference [RP09] on p. 80, also cited in this search report); figures 1,12,15, paragraph [1.1.;2.3.4].

Timmers, et al., "Vibrato: Questions and Answers From Musicians," (2000) Proceedings of the sixth ICMPC, Keele, 15 pages.

Virtanen, T., et al., "Combining Pitch-Based Inference and Non-Negative Spectrogram Factorization in Separating Vocals from Polyphonic Music," 2008, 6 pages, Accessed online Apr. 2, 2013 at www.sapaworkshops.org/2008/papers/107.pdf.

* cited by examiner

Arrow 1

Arrow 2

Arrow 3

Arrow 4

Arrow 5

Star 2

Star 4

Star 1

Star 3

```
j = -MAX_UP; min_val = 100000;
if ( C(t,p) > T )
    for (k=0; k < (MAX_UP + MAX_DN + 1); k++)
        d(k) = abs( C(t,p) - C(t+1,p+j+k) );
        if ( d(k) < min_val )
            min_index = k;
            min_val = d(k);
        end
    end
    if ( min_index == MAX_UP ) v(t,p) = 0;
    else v(t,p) = 1;
    end
end
```

method ME10

SYSTEMS, METHODS, APPARATUS, AND COMPUTER-READABLE MEDIA FOR PITCH TRAJECTORY ANALYSIS

CLAIM OF PRIORITY UNDER 35 U.S.C. §119

The present application for patent claims priority to Provisional Application No. 61/659,171, entitled "SYSTEMS, METHODS, APPARATUS, AND COMPUTER-READABLE MEDIA FOR PITCH TRAJECTORY ANALYSIS," filed Jun. 13, 2012, and assigned to the assignee hereof.

BACKGROUND

1. Field

This disclosure relates to audio signal processing.

2. Background

Vibrato refers to frequency modulation, and tremolo refers to amplitude modulation. For string instruments, vibrato is typically dominant. For woodwind and brass instruments, tremolo is typically dominant. For voice, vibrato and tremolo typically occur at the same time. The document "Singing voice detection in music tracks using direct voice vibrato detection" (L. Regnier et al., ICASSP 2009, IRCAM) investigates the problem of locating singing voice in music tracks.

SUMMARY

A method, according to a general configuration, of processing a signal that includes a vocal component and a non-vocal component is presented. This method includes calculating a plurality of pitch trajectory points, based on a measure of harmonic energy of the signal in a frequency domain, wherein the plurality includes a plurality of points of a first pitch trajectory of the vocal component and a plurality of points of a second pitch trajectory of the non-vocal component. This method also includes analyzing changes in a frequency of said first pitch trajectory over time and, based on a result of said analyzing, attenuating energy of the vocal component relative to energy of the non-vocal component to produce a processed signal. Computer-readable storage media (e.g., non-transitory media) having tangible features that cause a machine reading the features to perform such a method are also disclosed.

An apparatus, according to a general configuration, for processing a signal that includes a vocal component and a non-vocal component is presented. This apparatus includes means for calculating a plurality of pitch trajectory points that are based on a measure of harmonic energy of the signal in a frequency domain, wherein said plurality includes a plurality of points of a first pitch trajectory of the vocal component and a plurality of points of a second pitch trajectory of the non-vocal component. This apparatus also includes means for analyzing changes in a frequency of said first pitch trajectory over time; and means for attenuating energy of the vocal component relative to energy of the non-vocal component, based on a result of said analyzing, to produce a processed signal.

An apparatus, according to another general configuration, for processing a signal that includes a vocal component and a non-vocal component is presented. This apparatus includes a calculator configured to calculate a plurality of pitch trajectory points that are based on a measure of harmonic energy of the signal in a frequency domain, wherein said plurality includes a plurality of points of a first pitch trajectory of the vocal component and a plurality of points of a second pitch trajectory of the non-vocal component. This apparatus also includes an analyzer configured to analyze changes in a frequency of said first pitch trajectory over time; and an attenuator configured to attenuate energy of the vocal component relative to energy of the non-vocal component, based on a result of said analyzing, to produce a processed signal.

DETAILED DESCRIPTION

Figure 1:
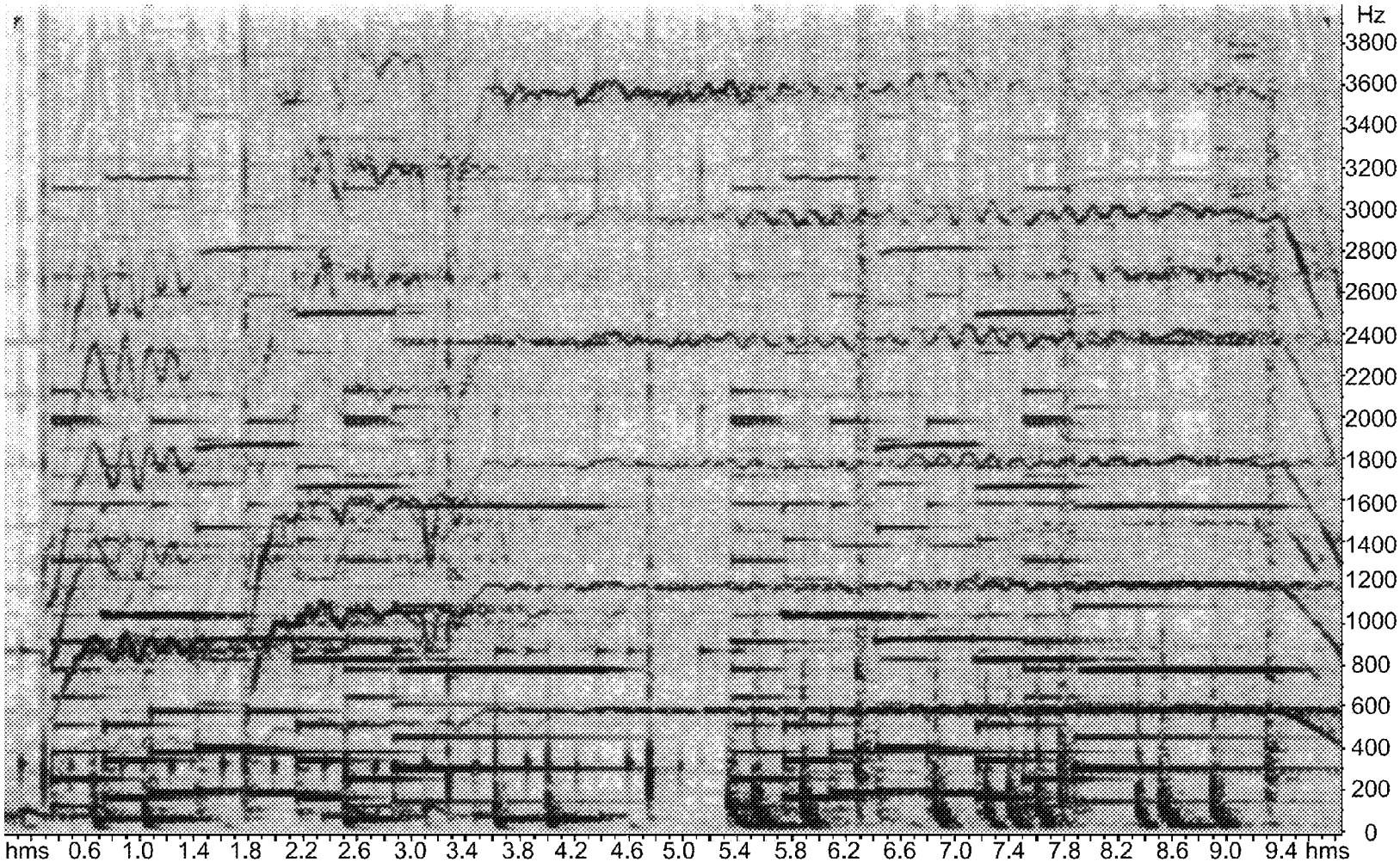
FIG. 1 shows an example of a spectrogram of a mixture signal.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B" or "A is the same as B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample (or "bin") of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

Any incorporation by reference of a portion of a document shall also be understood to incorporate definitions of terms or variables that are referenced within the portion, where such definitions appear elsewhere in the document, as well as any figures referenced in the incorporated portion. Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, each of the terms "plurality" and "set" is used herein to indicate an integer quantity that is greater than one.

Musicians routinely add expressive aspects to singing and instrument performances. These aspects may include one or more expressive effects, such as vibrato, tremolo, and/or glissando (a glide from an initial pitch to a different, terminal pitch). FIG. 1 shows an example of a spectrogram of a mixture signal that includes vocal, flute, plano, and percussion components. Vibrato of a vocal component is clearly visible near the beginning of the spectrogram, and glissandi are visible at the beginning and end of the spectrogram.

Vibrato and tremolo can each be characterized by two elements: the rate or frequency of the effect, and the amplitude or extent of the effect. For voice, the average rate of vibrato is around 6 Hz and may increase exponentially over the duration of a note event, and the average extent of vibrato is about 0.6 to 2 semitones. For string instruments, the average rate of vibrato is about 5.5 to 8 Hz, and the average extent of vibrato is about 0.2 to 0.35 semitones; similar ranges apply for woodwind and brass instruments.

Expressive effects, such as vibrato, tremolo, and/or glissando, may also be used to discriminate between vocal and instrumental components of a music signal. For example, it may be desirable to detect vocal components by using vibrato (or vibrato and tremolo). Features that may be used to discriminate vocal components of a mixture signal from musical instrument components of the signal include average rate, average extent, and a presence of both vibrato and tremolo modulations. In one example, a partial is classified as a singing sound if (1) the rate value is around 6 Hz and (2) the extent values of its vibrato and tremolo are both greater than the threshold.

It may be desirable to implement a note recovery framework to recover individual notes and note activations from mixture signal inputs (e.g., from single-channel mixture signals). Such note recovery may be performed, for example, using an inventory of timbre models that correspond to different instruments. Such an inventory is typically implemented to model basic instrument note timbre, such that the inventory should address mixtures of piecewise stable pitched ("dull") note sequences. Examples of such a recovery framework are described, for example, in U.S. Publ. Pat. Appls. Nos. 2012/0101826 A1 (Visser et al., publ. Apr. 26, 2012) and 2012/0128165 A1 (Visser et al., publ. May 24, 2012).

Pitch trajectories of vocal components are typically too complex to be modeled exhaustively by a practical inventory of timbre models. However, such trajectories are usually the most salient note patterns in a mixture signal, and they may interfere with the recovery of the instrumental components of the mixture signal.

It may be desirable to label the patterns produced by one or more of such expressive effects and to filter out these labeled patterns before the music scene analysis stage. For example, it may be desirable for pre-processing of a mixture signal for a note recovery framework to include removal of vocal components and vibrato modulations. Such an operation may be used to identify and remove a rapidly varying or otherwise unstable pitch trajectory from a mixture signal before applying a note recovery technique.

Pre-processing for a note recovery framework as described herein may include stable/unstable pitch analysis and filtering based on an amplitude-modulation spectrogram. It may be desirable to remove a varying pitch trajectory, and/or to remove a stable pitch trajectory, from the spectrogram. In another case, it may be desirable to keep only a stable pitch trajectory, or a varying pitch trajectory. In a further case, it may be desirable to keep only some stable table pitch trajectory and some instrument's varying pitch trajectory. To achieve such results, it may be desirable to understand pitch stability and to have the ability to control it.

Applications for a method of identifying a varying pitch trajectory as described herein include automated transcription of a mixture signal and removal of vocal components from a mixture signal (e.g., a single-channel mixture signal), which may be useful for karaoke.

Figure 2A:
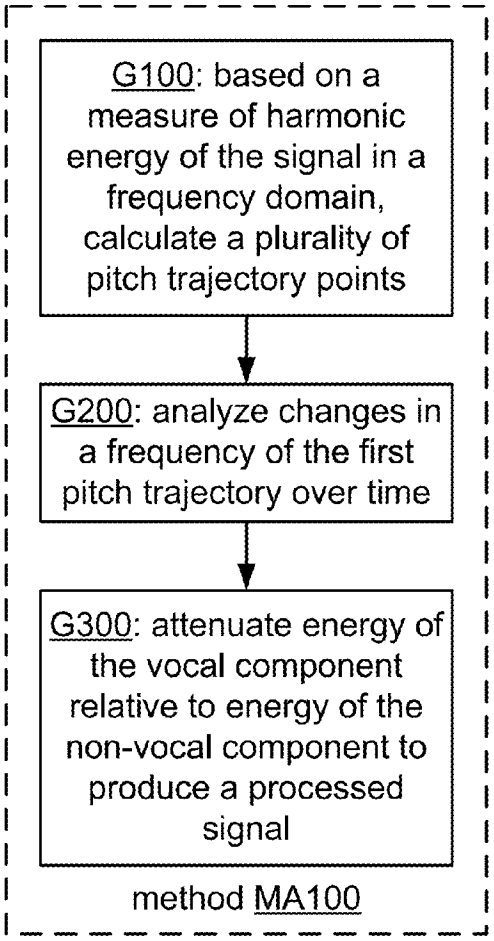
FIG. 2A shows a flowchart of a method MA100 according to a general configuration.

FIG. 2A shows a flowchart for a method MA100, according to a general configuration, of processing a signal that includes a vocal component and a non-vocal component, wherein method MA100 includes tasks G100, G200, and G300. Based on a measure of harmonic energy of the signal in a frequency domain, task G100 calculates a plurality of pitch trajectory points. The plurality of pitch trajectory points includes a plurality of points of a first pitch trajectory of the vocal component and a plurality of points of a second pitch trajectory of the non-vocal component. Task G200 analyzes changes in a frequency of the first pitch trajectory over time. Based on a result of task G200, task G300 attenuates energy of the vocal component relative to energy of the non-vocal component to produce a processed signal. The signal may be a single-channel signal or one or more channels of a multichannel signal. The signal may also include other components, such as one or more additional vocal components and/or one or more additional non-vocal components (e.g., note events produced by different musical instruments).

Figure 2B:
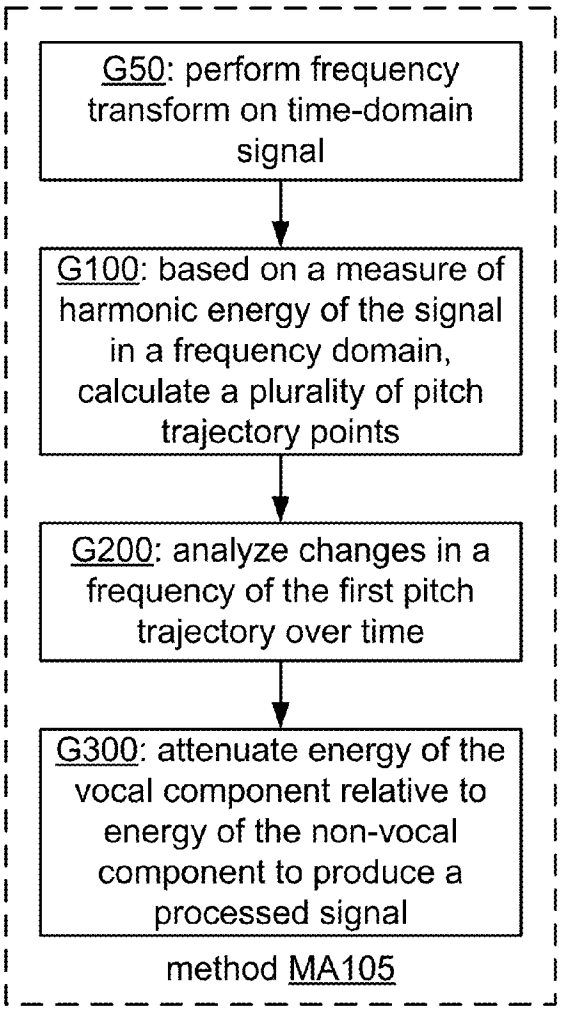
FIG. 2B shows a flowchart of an implementation MA105 of method MA100.

Method MA100 may include converting the signal to the frequency domain (i.e., converting the signal to a time series of frequency-domain vectors or "spectrogram frames") by transforming each of a sequence of blocks of samples of the time-domain mixture signal into a corresponding frequency-domain vector. For example, method MA100 may include performing a short-time Fourier transform (STFT, using e.g. a fast Fourier transform or FFT) on the mixture signal to produce the spectrogram. Examples of other frequency transforms that may be used include the modified discrete cosine transform (MDCT). It may be desirable to use a complex transform (e.g., a complex lapped transform (CLT), or a discrete cosine transform and a discrete sine transform) to preserve phase information. FIG. 2B shows a flowchart of an implementation MA105 of method MA100 which includes a task G50 that performs a frequency transform on the time-domain signal to produce the signal in the frequency domain.

Based on a measure of harmonic energy of the signal in a frequency domain, task G100 calculates a plurality of pitch trajectory points. Task G100 may be implemented such that the measure of harmonic energy of the signal in the frequency domain is a summary statistic of the signal. In such case, task G100 may be implemented to calculate a corresponding value C(t,p) of the summary statistic for each of a plurality of points of the signal in the frequency domain. For example, task G100 may be implemented such that each value C(t,p) corresponds to one of a sequence of time intervals and one of a set of pitch frequencies.

Task G100 may be implemented such that each value C(t,p) of the summary statistic is based on values from more than one frequency component of the spectrogram. For example, task G100 may be implemented such that values C(t,p) of the summary statistic for each pitch frequency p and time interval t are based on the spectrogram value for time interval t at a pitch fundamental frequency p and also in the spectrogram values for time interval t at integer multiples of pitch fundamental frequency p. Integer multiples of a fundamental frequency are also called "harmonics." Such an approach may help to emphasize salient pitch contours within the mixture signal.

One example of such a measure C(t,p) is a sum of the magnitude responses of spectrogram for time interval t at frequency p and corresponding harmonic frequencies (i.e., integer multiples of p), where the sum is normalized by the number of harmonics in the sum. Another example is a normalized sum of the magnitude responses of spectrogram for time interval t at only those corresponding harmonics of frequency p that are above a certain threshold frequency. Such a threshold frequency may depend on a frequency resolution of the spectrogram (e.g., as determined by the size of the FFT used to produce the spectrogram).

Figure 2C:
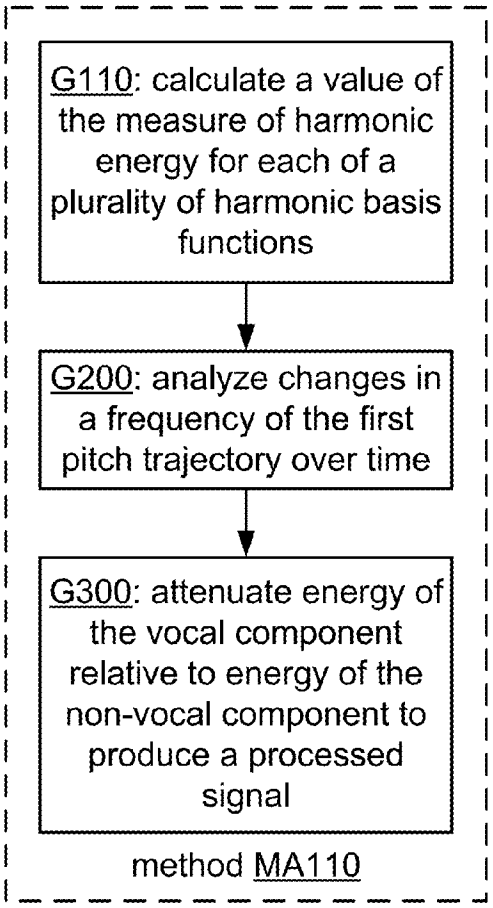
FIG. 2C shows a flowchart of an implementation MA110 of method MA100.
Figure 3:
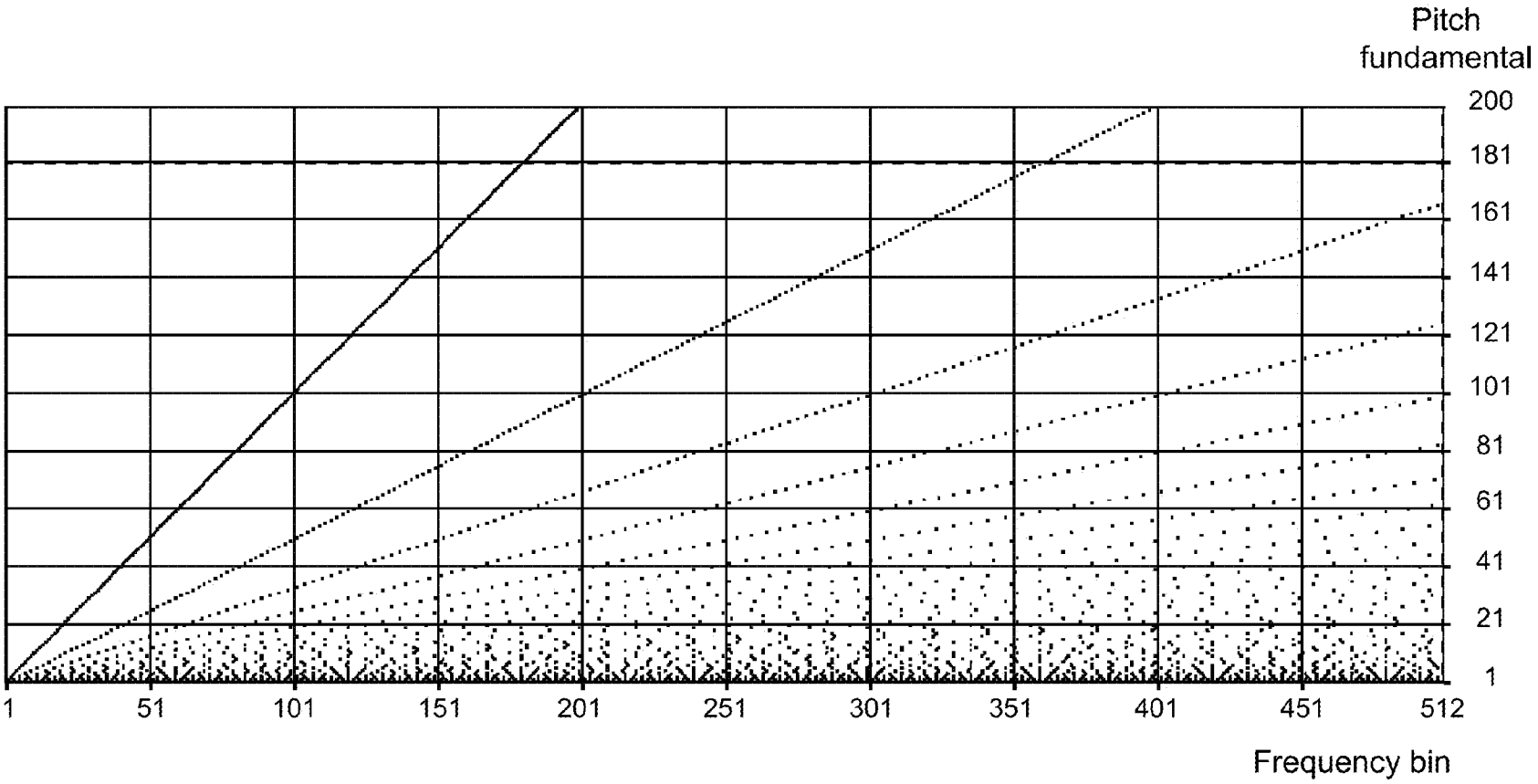
FIG. 3 shows an example of a pitch matrix.
Figure 4:
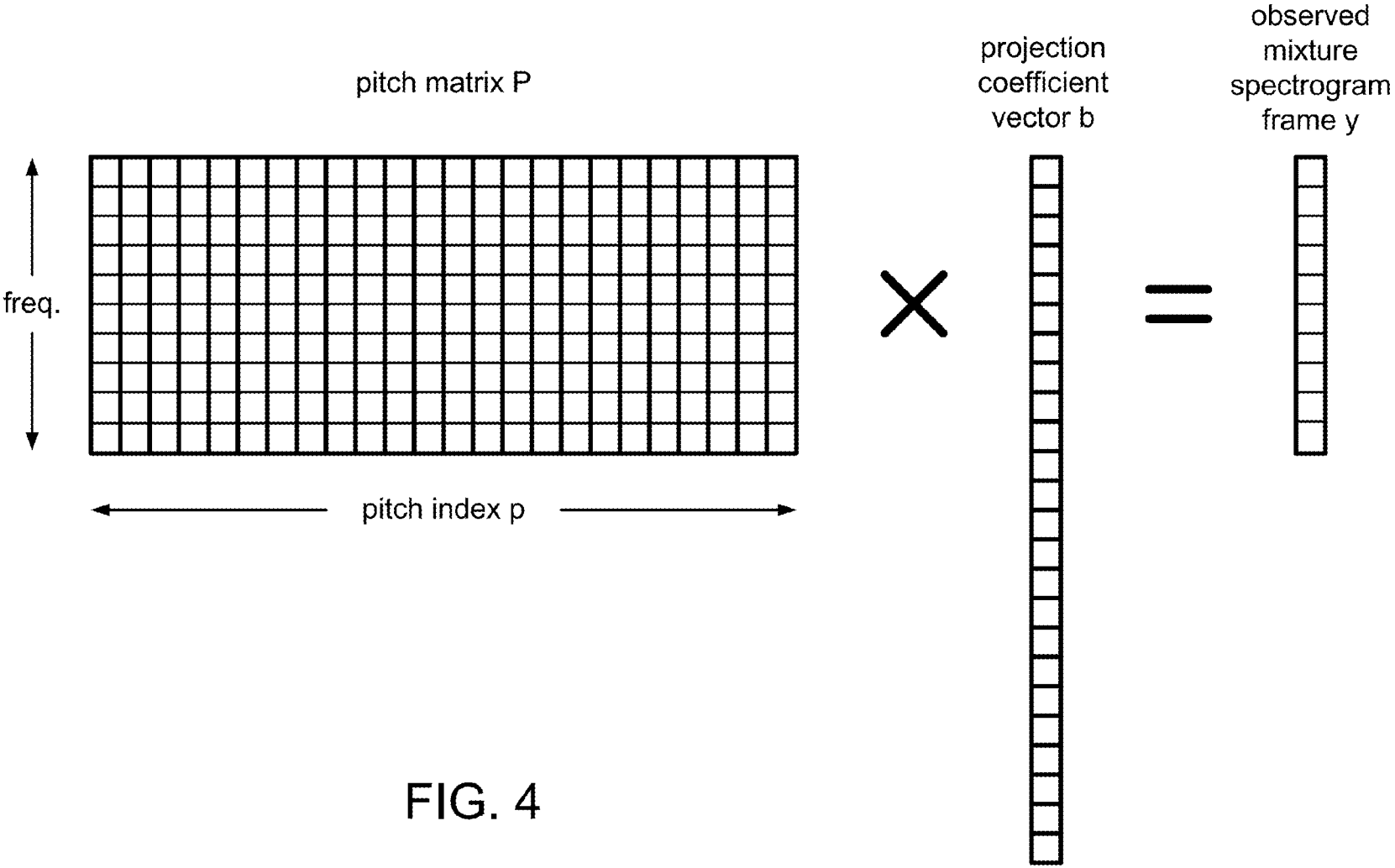
FIG. 4 shows a model of a mixture spectrogram as a linear combination of basis function vectors.

FIG. 2C shows a flowchart for an implementation MA110 of method MA10 that includes a similar implementation G110 of task G100. Task G110 calculates a value of the measure of harmonic energy for each of a plurality of harmonic basis functions. For example, task G110 may be implemented to calculate values C(t,p) of the summary statistic as projection coefficients (also called "activation coefficients") by using a pitch matrix P to model each spectrogram frame in a pitch matrix space. FIG. 3 shows an example of a pitch matrix P that includes a set of harmonic basis functions. Each column of matrix P is a basis function that corresponds to a fundamental pitch frequency p and harmonics of the fundamental frequency p. In one example, the values of matrix P may be expressed as follows:

$$P_{ij} = \begin{cases} \frac{1}{F \bmod j}, & i \bmod j = i/j \\ 0, & \text{otherwise} \end{cases},$$

where i and j are row and column indices, respectively, and F denotes the number of frequency bins. Different weightings may also be used, for example, to emphasize harmonic events corresponding to low fundamentals or high fundamentals. It may be desirable to implement task G100 to model each frame y of the spectrogram as a linear combination of these basis functions (e.g., as shown in the model of FIG. 4).

Figure 5:
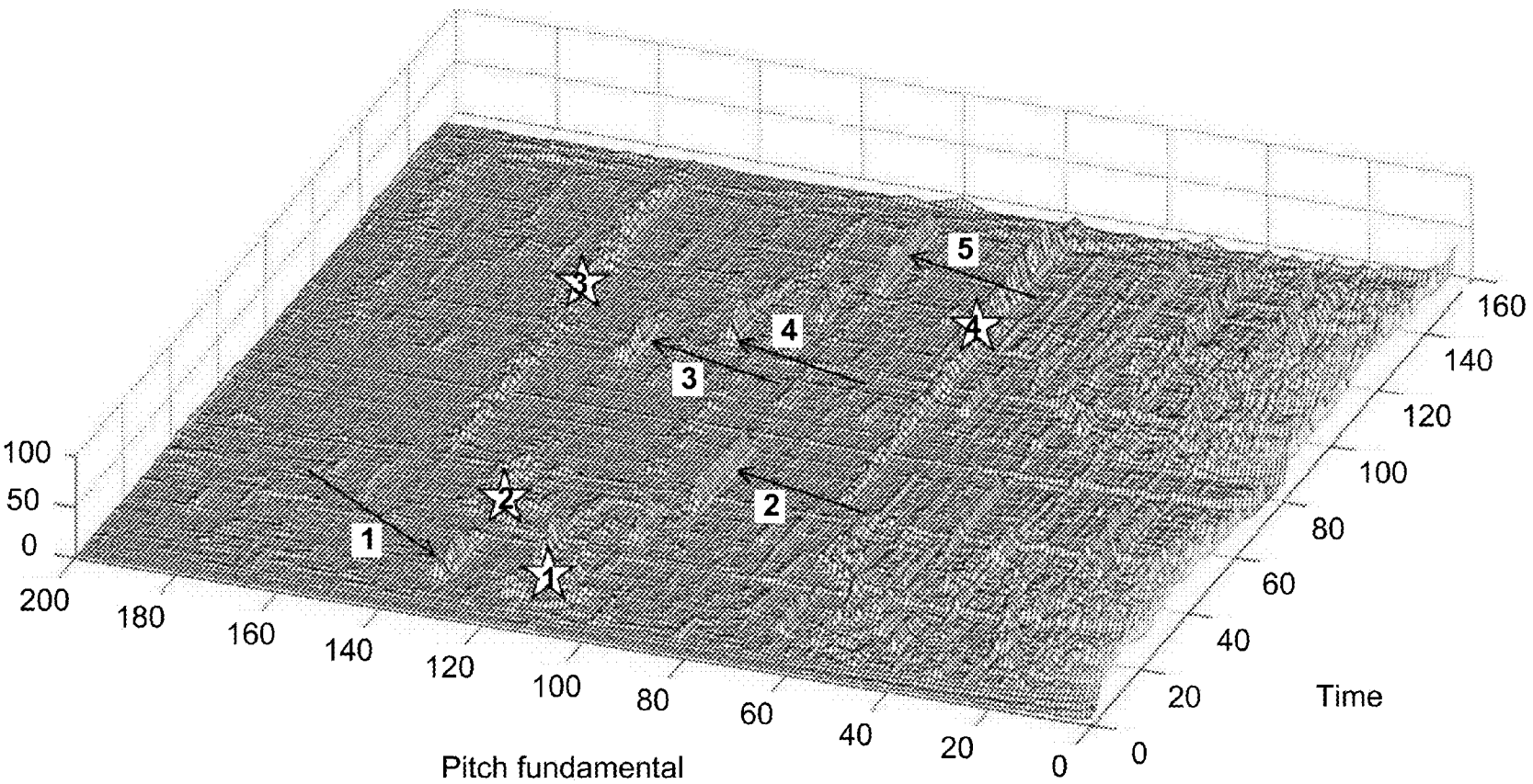
FIG. 5 shows an example of a plot of projection coefficient vectors.
Figure 9A:
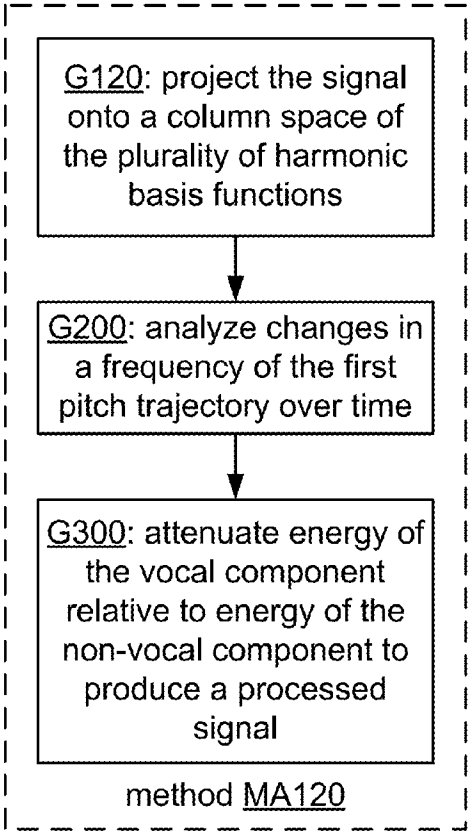
FIG. 9A shows a flowchart of an implementation MA120 of method MA100.

FIG. 9A shows a flowchart of an implementation MA120 of method MA100 that includes an implementation G120 of task G110. Task G120 projects the signal onto a column space of the plurality of harmonic basis functions. FIG. 5 shows an example of a plot of vectors of projection coefficients C(t,p) obtained by executing an instance of task G120, for each frame of the spectrogram, to project the frame onto the column space of the pitch matrix as shown in FIG. 4. Methods MA110 and MA120 may also be implemented as implementations of method MA105 (e.g., including an instance of frequency transform task G50).

Another approach includes producing a corresponding value C(t,f) of a summary statistic for each time-frequency point of the spectrogram. In one such example, each value of the summary statistic is the magnitude of the corresponding time-frequency point of the spectrogram.

Figure 6:
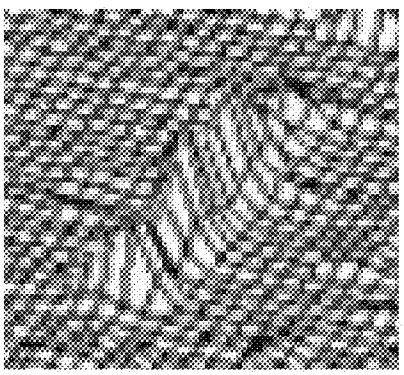
FIG. 6 shows the areas indicated by arrows in FIG. 5.
Figure 6:
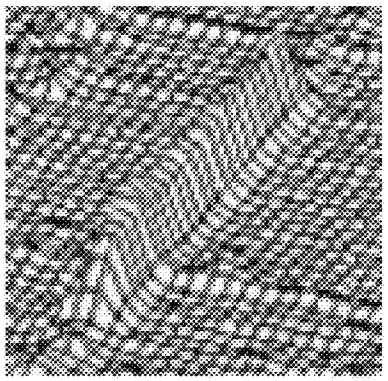
Figure 6:
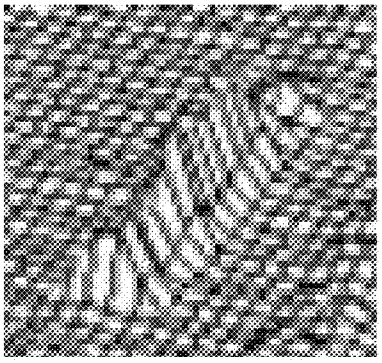
Figure 6:
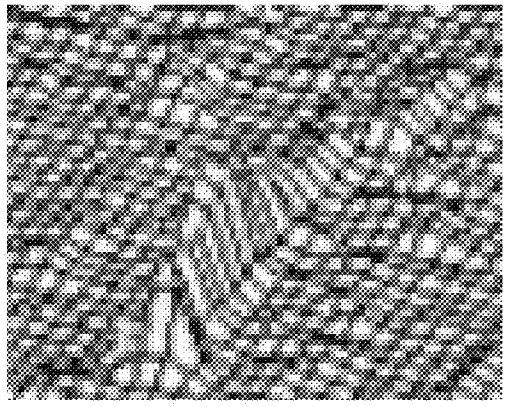
Figure 6:
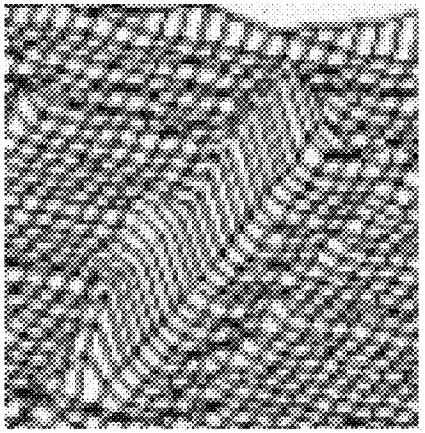
Figure 7:
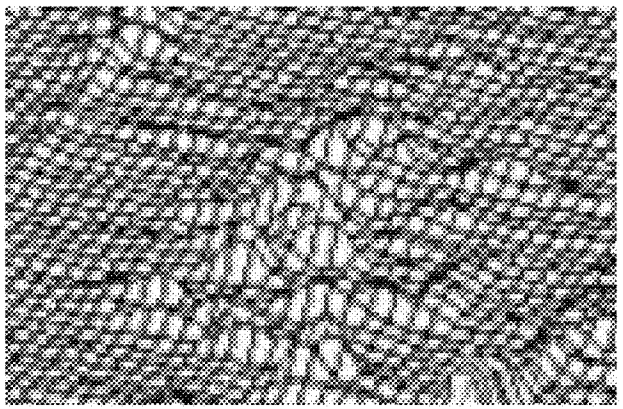
FIG. 7 shows the areas indicated by stars in FIG. 5.
Figure 7:
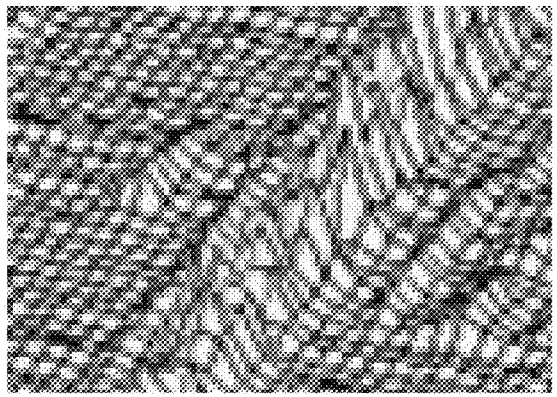
Figure 7:
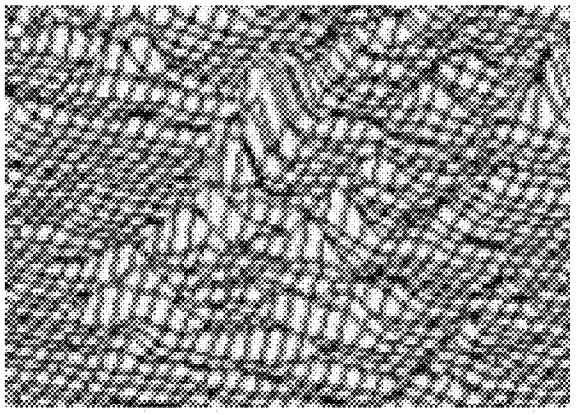
Figure 7:
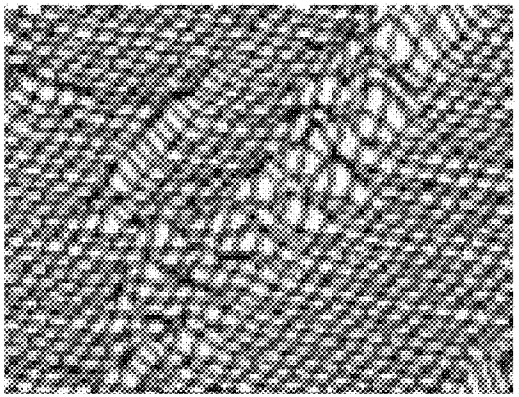
Figure 8:
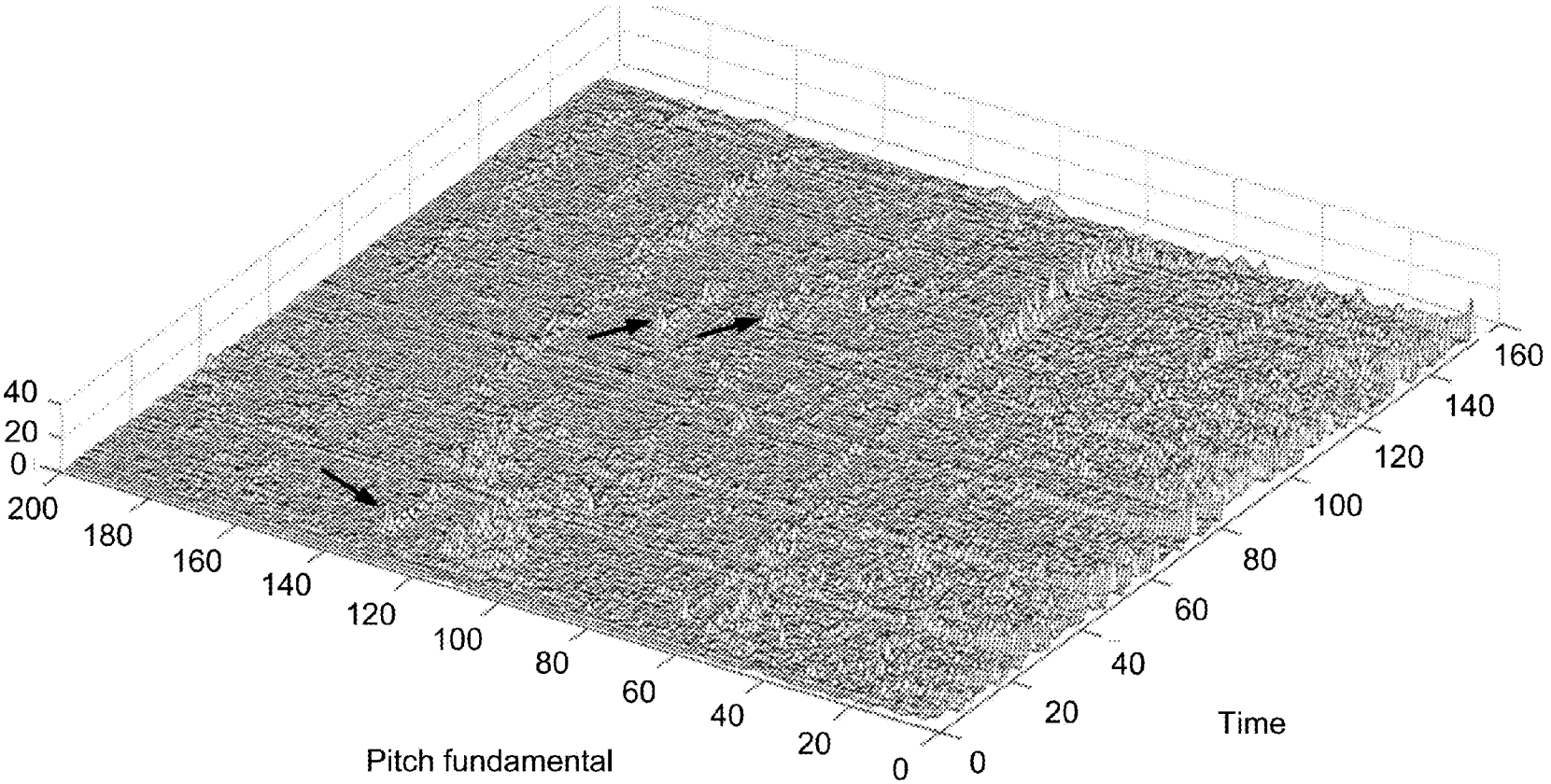
FIG. 8 shows an example of a result of performing a delta operation on the vectors of FIG. 5.

It may be desirable to distinguish steady pitch trajectories, such as those of pitched harmonic instruments (e.g., as indicated by the arrows in FIG. 5 and as also shown in close-up in FIG. 6), from varying pitch trajectories, such as those from vocal components (e.g., as indicated by the stars in FIG. 5 and as also shown in close-up in FIG. 7). A rapidly varying pitch contour may be identified by measuring the change in spectrogram amplitude from frame to frame (i.e., a simple delta operation). FIG. 8 shows an example of such a delta plot in which many stable pitched notes have been removed. However, this simple delta operation does not discriminate between vertically evolving pitch trajectories and other events (indicated by arrows, corresponding to the stable trajectories indicated in FIG. 5 by the arrows 1, 3, and 4) such as tremolo effects and onsets and offsets of stable pitched notes. Such a method may be very sensitive to such other events, and it may be desirable to use a more suitable operation to distinguish steady pitch trajectories from varying pitch trajectories.

Task G200 analyzes changes in a frequency of the pitch trajectory of the vocal component of the signal over time. Such analysis may be used to distinguish the pitch trajectory of the vocal component (a time-varying pitch trajectory) from a steady pitch trajectory (e.g., from a non-vocal component, such as an instrument).

Figure 9B:
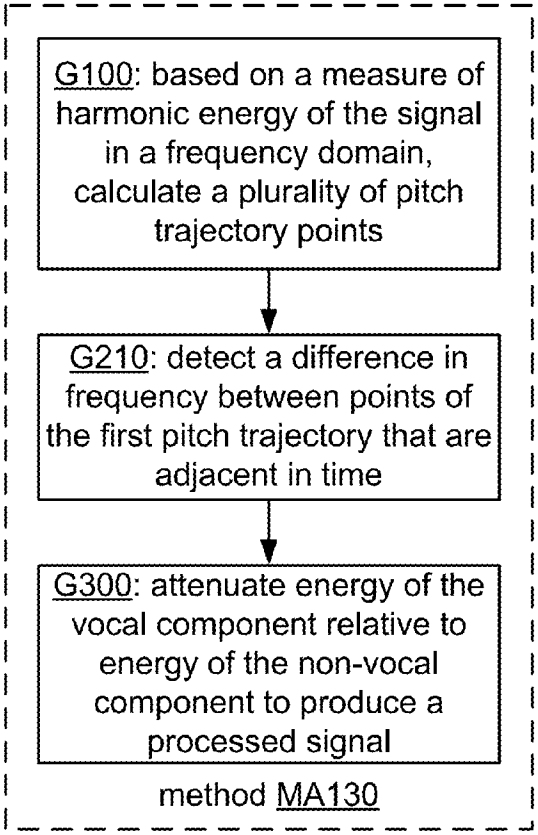
FIG. 9B shows a flowchart of an implementation MA130 of method MA100.

FIG. 9B shows a flowchart of an implementation MA130 of method MA100 that includes an implementation G210 of task G200. Task G210 detects a difference in frequency between points of the first pitch trajectory that are adjacent in time. Task G210 may be performed, for example, using a gradient analysis approach. Such an approach may be implemented to use a sequence of operations such as the following to analyze amplitude gradients of summary statistic C(t,p) in vertical directions:

1) For every C(t,p) coefficient that exceeds a certain threshold T, measure the following gradients:

$$C4 = |C(t, p) - C(t+1, p+4)| \text{ (move vertical up)}$$

$$\ldots$$

$$C1 = |C(t, p) - C(t+1, p+1)| \text{ (move vertical up)}$$

$$C0 = |C(t, p) - C(t+1, p)| \text{ (move directly sideways)}$$

-continued $$C-1 = |C(t, p) - C(t+1, p-1)| \text{ (move vertical down)}$$

$$\ldots$$

$$C-4 = |C(t, p) - C(t+1, p-4)| \text{ (move vertical down).}$$

2) Identify the index of the minimum value among the gradients [C-4, C-3, C-2, C-1, C0, C1, C2, C3, C4].

3) If the index of the minimum value is different from 5 (i.e., if C0 is not the minimum-valued gradient), then the pitch trajectory moves vertically, and the point (t,p) is labeled as 1. Otherwise (e.g., for a steady pitch trajectory that moves only horizontally), the point (t,p) is labeled as zero.

Figures 10A, 10B:
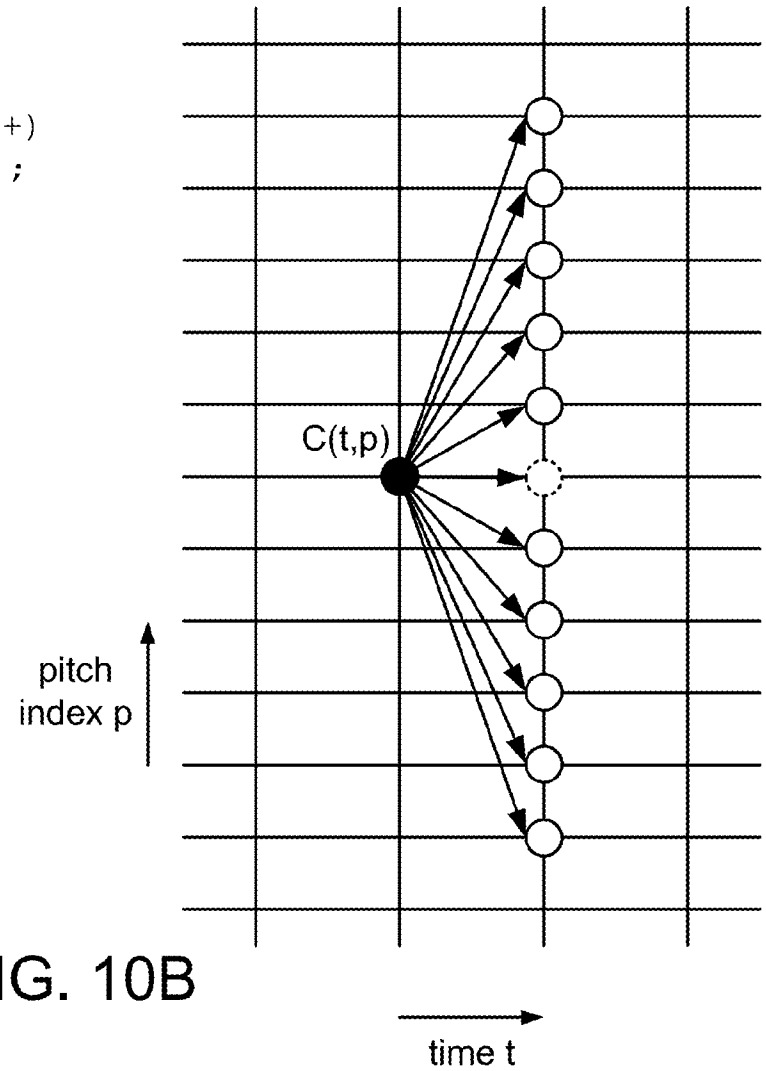
FIG. 10A shows a pseudocode listing for a gradient analysis method.
FIG. 10B illustrates an example of the context of a gradient analysis method.

FIG. 10A shows a pseudocode listing for such a gradient analysis method in which MAX_UP indicates the maximum pitch displacement to be analyzed in one direction, MAX_DN indicates the maximum pitch displacement to be analyzed in the other direction, and v(t,p) indicates the analysis result for frame (t,p). FIG. 10B illustrates an example of the context of such a procedure for a case in which MAX_UP and MAX_DN are both equal to five. It is also possible for the value of MAX_UP to differ from the value of MAX_DN and/or for the values of MAX_UP and/or MAX_DN to change from one frame to another.

Figure 9C:
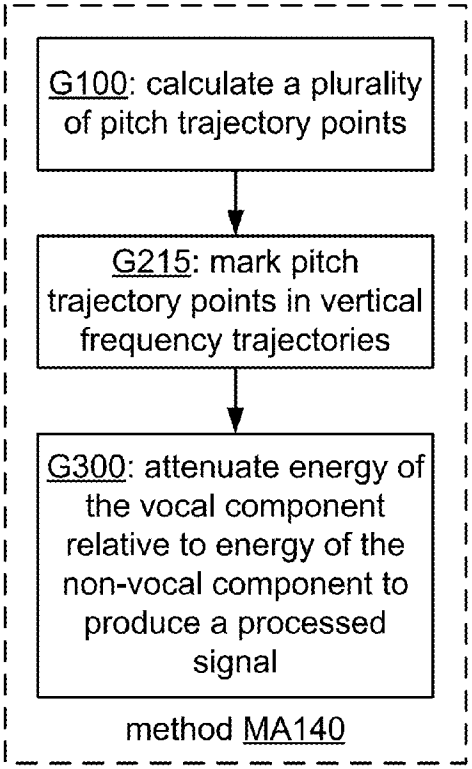
FIG. 9C shows a flowchart of an implementation MA140 of method MA100.
Figure 11:
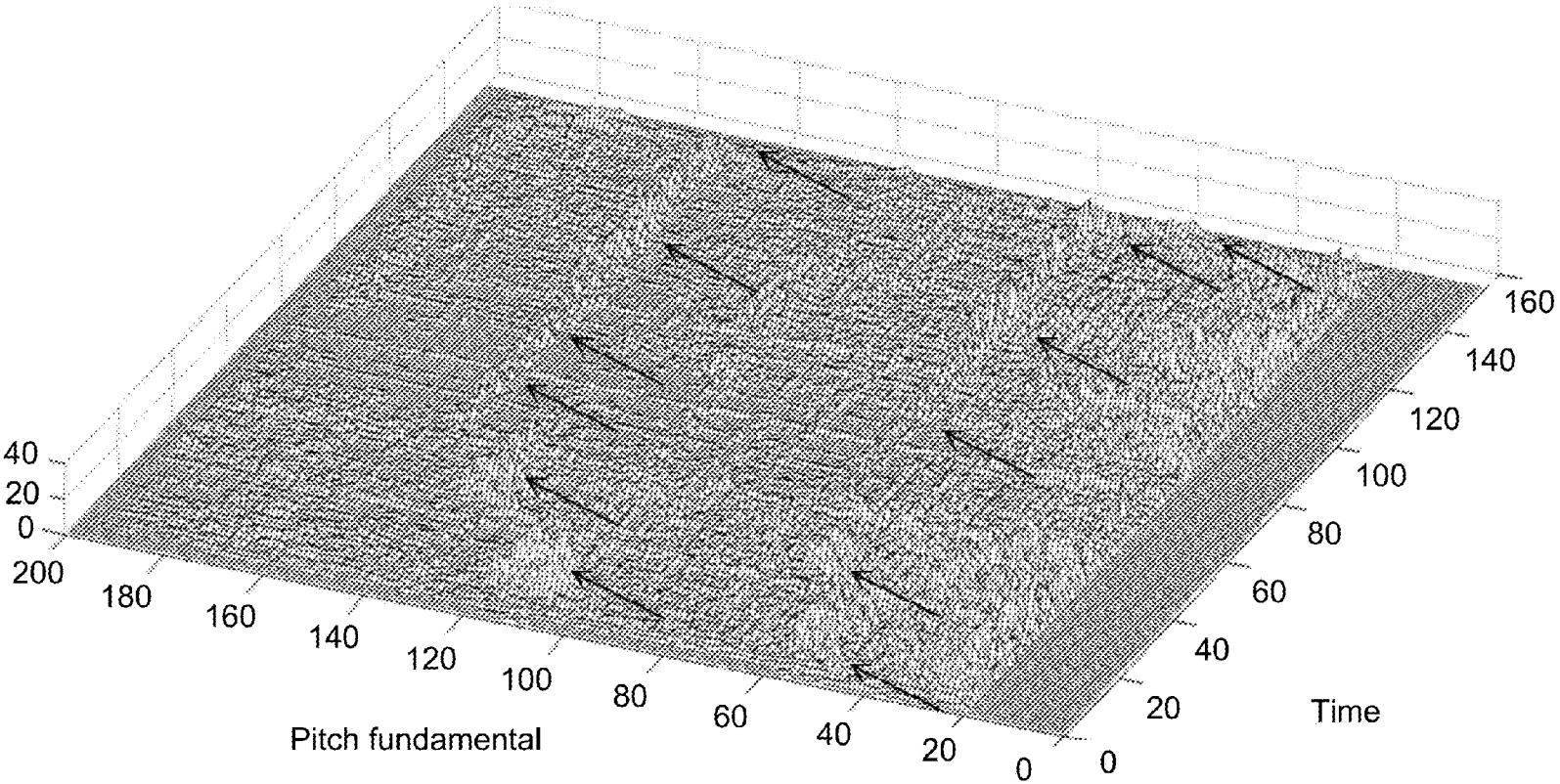
FIG. 11 shows an example of weighting the vectors of FIG. 5 by the corresponding results of a gradient analysis.

FIG. 9C shows a flowchart of an implementation MA140 of method MA130 that includes an implementation G215 of task G210. Task G215 marks pitch trajectory points, among the plurality of points calculated by task G100, that are in vertical frequency trajectories (e.g., using a gradient analysis approach as set forth above). FIG. 11 shows an example in which the values C(t,p) as shown in FIG. 5 are weighted by the corresponding results v(t,p) of such a gradient analysis. The arrows indicate varying pitch trajectories of vocal components that are emphasized by such labeling.

Figure 12A:
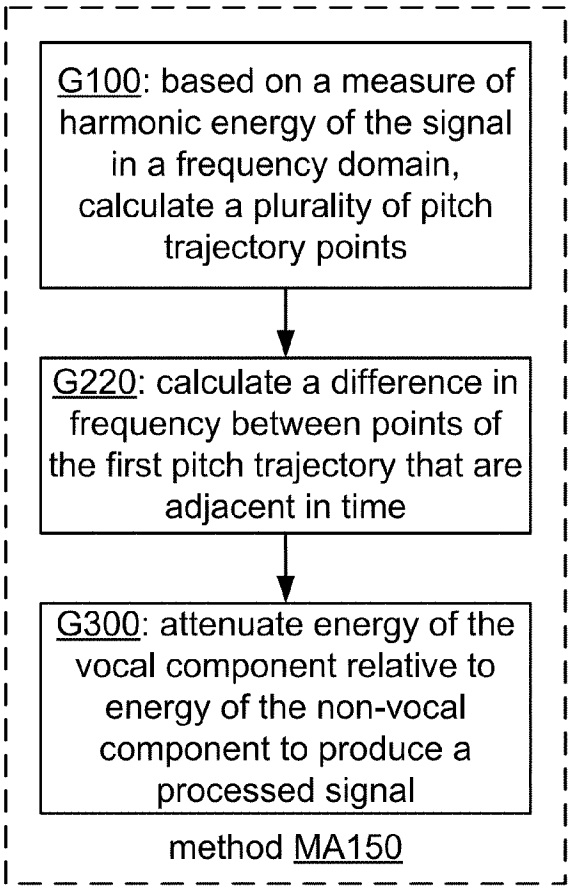
FIG. 12A shows a flowchart of an implementation MA150 of method MA100.
Figure 12B:
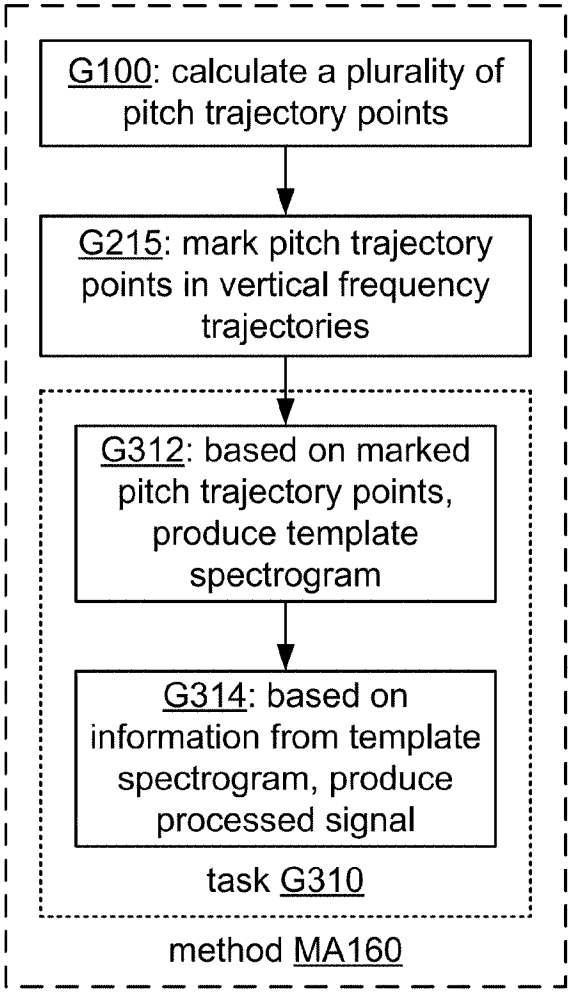
FIG. 12B shows a flowchart of an implementation MA160 of method MA100.

FIG. 12A shows a flowchart of an implementation MA150 of method MA100 that includes an implementation G220 of task G200. Task G220 calculates a difference in frequency between points of the first pitch trajectory that are adjacent in time. Task G220 may be performed, for example, by modifying the gradient analysis as described above such that the label of a point (t,p) indicates only the detection of a frequency change over time, but also a direction and/or magnitude of the change. Such information may be used to classify vibrato and/or glissando components as described below. Methods MA130, MA140, and MA150 may also be implemented as implementations of method MA105, MA110, and/or MA120.

Based on a result of the analysis performed by task G200, task G300 attenuates energy of the vocal component of the signal, relative to energy of the non-vocal component of the signal, to produce a processed signal. FIG. 11B shows a flowchart of an implementation MA160 of method MA140 that includes an implementation G310 of task G300 which includes subtasks G312, G314, and G316. Method MA160 may also be implemented as an implementation of method MA105, MA110, and/or MA120.

Based on the pitch trajectory points marked in task G215, task G312 produces a template spectrogram. In one example, task G312 is implemented to produce the template spectrogram by using the pitch matrix to project the vertically moving coefficients marked by task G215 (e.g., masked coefficient vectors) back into spectrogram space.

Based on information from the template spectrogram, task G314 produces the processed signal. In one example, task G314 is implemented to subtract the template spectrogram of varying pitch trajectories from the original spectrogram. FIG.

13 shows a result of performing such a subtraction on the spectrogram of FIG. 1 to produce the processed signal as a piecewise stable-pitched note sequence spectrogram, in which it may be seen that the magnitudes of the vibrato and glissando components are greatly reduced relative to the magnitudes of the stable pitched components.

Figure 12C:
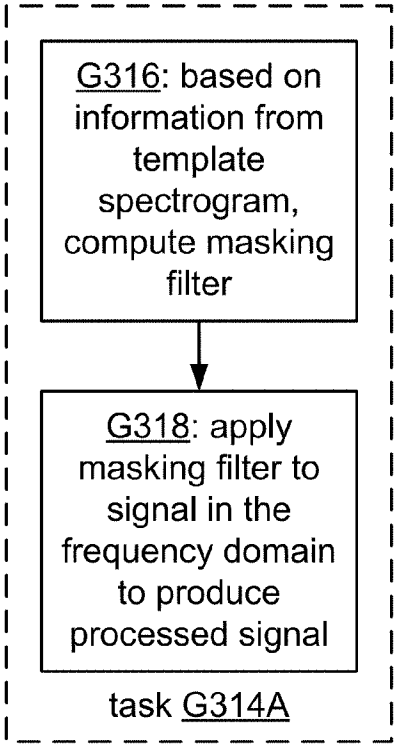
FIG. 12C shows a flowchart of an implementation G314A of task G314.
Figure 13:
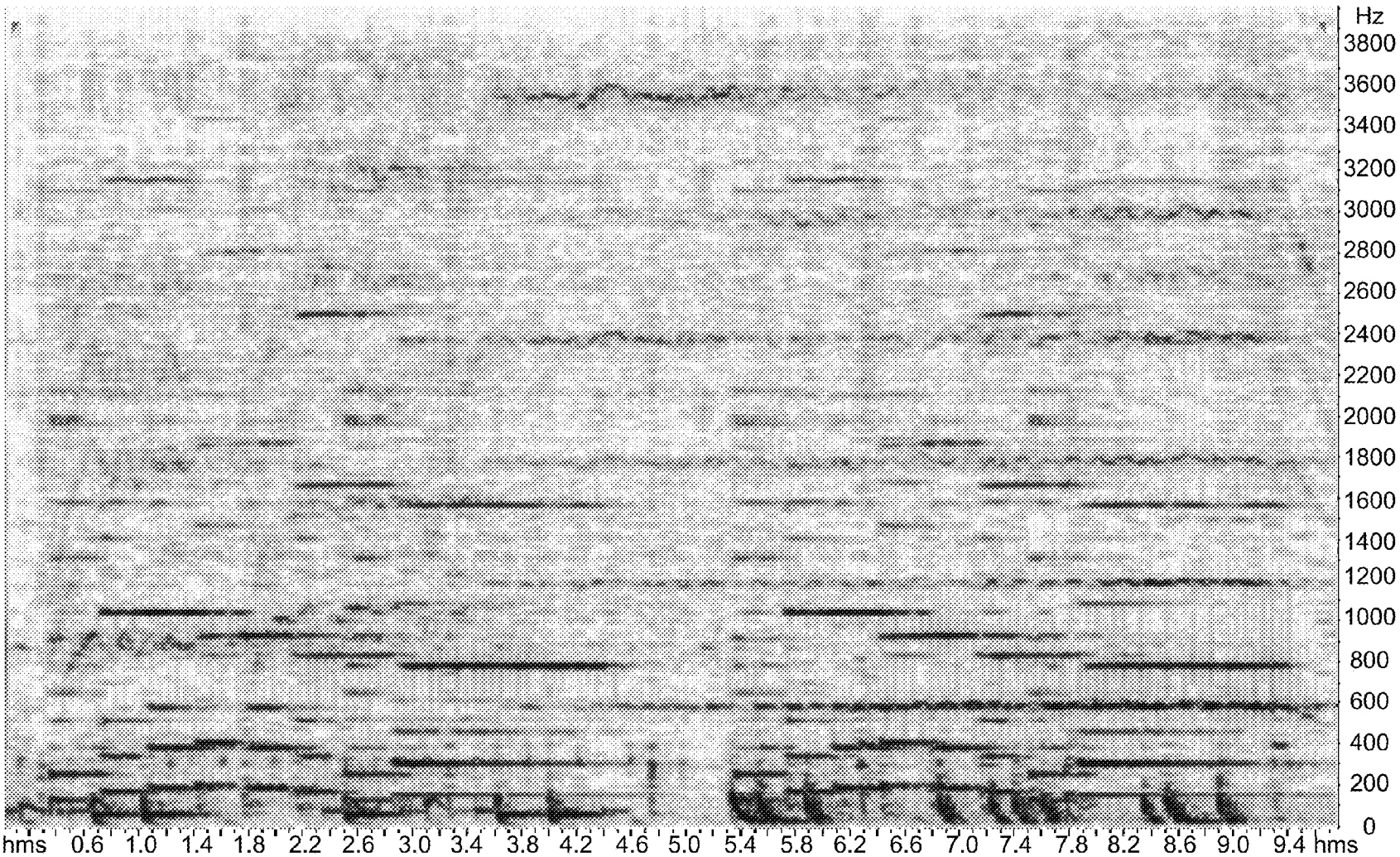
FIG. 13 shows a result of subtracting a template spectrogram, based on the weighted vectors of FIG. 11, from the spectrogram of FIG. 1.

FIG. 12C shows a flowchart of an implementation G314A of task G314 that includes subtasks G316 and G318. Based on information from the template spectrogram produced by task G312, task T316 computes a masking filter. For example, task T316 may be implemented to produce the masking filter by subtracting the template spectrogram from the original mixture spectrogram and comparing the energy of the resulting residual spectrogram to the energy of the original spectrogram (e.g., for each time-frequency point of the mask). Task G318 applies the masking filter to the signal in the frequency domain to produce the processed signal (e.g., a spectrogram that contains sequences of piecewise-constant stable pitched instrument notes).

As an alternative to a gradient analysis approach as described above, task G200 may be performed using a frequency analysis approach. Such an approach includes performing a frequency transform, such as an STFT (using e.g. an FFT) or other transform (e.g., DCT, MDCT, wavelet transform), on the pitch trajectory points (e.g., the values of summary statistic C(t,p)) produced by task G100.

Under this approach, it may be desirable to consider a function of the magnitude response of each subband (e.g., frequency bin) of a music signal as a time series (e.g., in the form of a spectrogram). Examples of such functions include, without limitation, abs (magnitude response) and 20*log 10(abs(magnitude response)).

Pitch and its harmonic structure typically behave coherently. An unstable part of a pitch component (e.g., a part that varies over time), such as vibrato and glissandi, is typically well-associated in such a representation with the stable part or stabilized part of the pitch component. It may be desirable to quantify the stability of each pitch and its corresponding harmonic components, and/or to filter the stable/unstable part, and/or to label each segment with the corresponding instrument.

Task G200 may be implemented to perform a frequency analysis approach to indicate the pitch stability for each candidate in the pitch inventory by dividing the time axis into blocks of size T1 and, for each pitch frequency p, applying the STFT to each block of values C(t,p) to obtain a series of fluctuation vectors for the pitch frequency.

Figure 14:
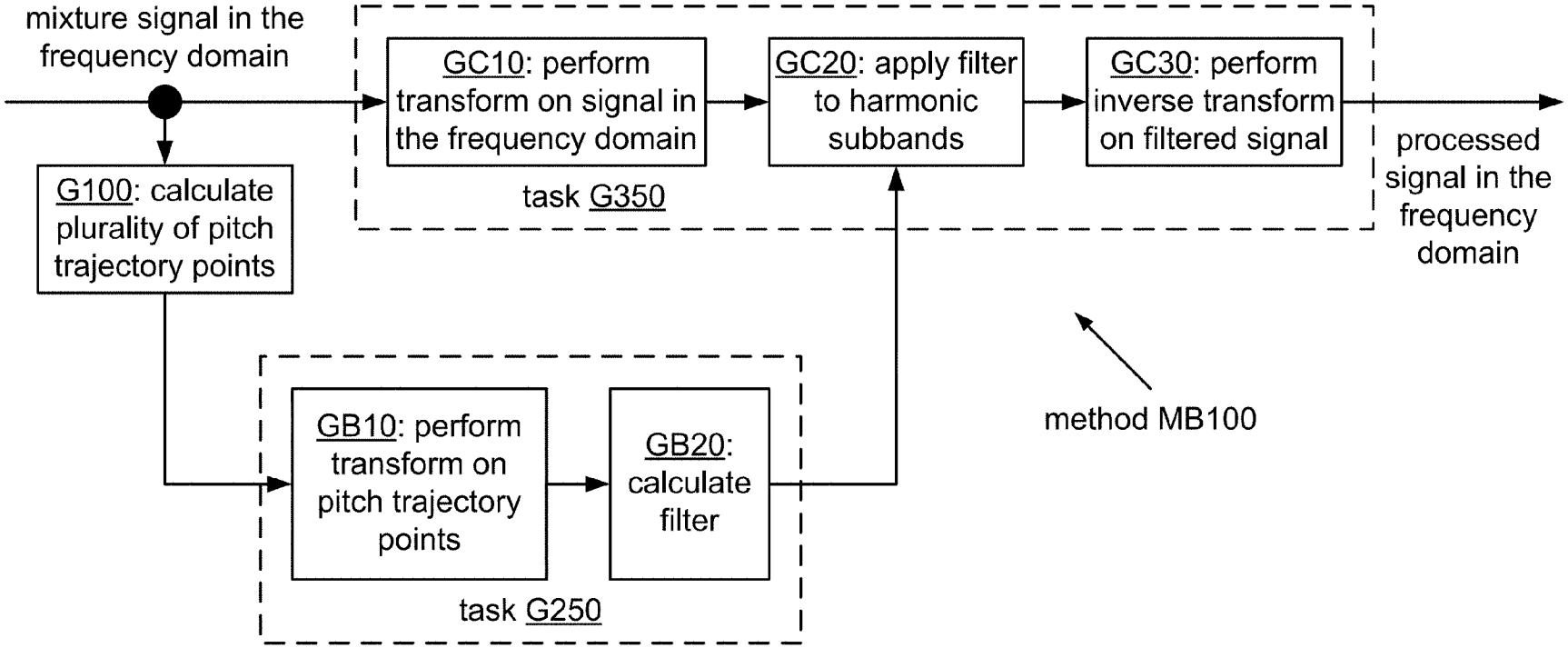
FIG. 14 shows a flowchart of an implementation MB100 of method MA100.

FIG. 14 shows a flowchart for an implementation MB100 of method MA100 that includes such a frequency analysis. Method MB100 includes an instance of task G100 that calculates a plurality of pitch trajectory points as described herein and may also include an instance of task G50 that computes a spectrogram of the mixture signal as described herein.

Method MB100 also includes an implementation G250 of task G200 that includes subtasks GB10 and GB20. For each pitch frequency p, task GB10 applies the STFT to each block of values C(t,p) to obtain a series of fluctuation vectors that indicate pitch stability for the pitch frequency. Based on the series of fluctuation vectors, task GB20 obtains a filter for each pitch candidate and corresponding harmonic bins, with low-pass/high-pass operation as needed. For example, task GB20 may be implemented to produce a lowpass or DC-pass filter to select harmonic components that have steady pitch trajectories and/or to produce a highpass filter to select harmonic components that have varying trajectories. In another example, task GB20 is implemented to produce a bandpass filter to select harmonic components having low-rate vibrato trajectories and a highpass filter to select harmonic components having high-rate vibrato trajectories.

Method MB100 also includes an implementation G350 of task G300 that includes subtasks GC10, GC20, and GC30. Task GC10 applies the same transform as task GB10 (e.g., STFT, such as FFT) to the spectrogram to obtain a subband-domain spectrogram. Task GC20 applies the filter calculated by task GB20 to the subband-domain spectrogram to select harmonic components associated with the desired trajectories. Task GC20 may be configured to apply the same filter, for each subband bin, to each pitch candidate and its harmonic bins. Task GC30 applies an inverse STFT to the filtered results to obtain a spectrogram magnitude representation of the selected trajectories (e.g., steady or varying).

Figure 15:
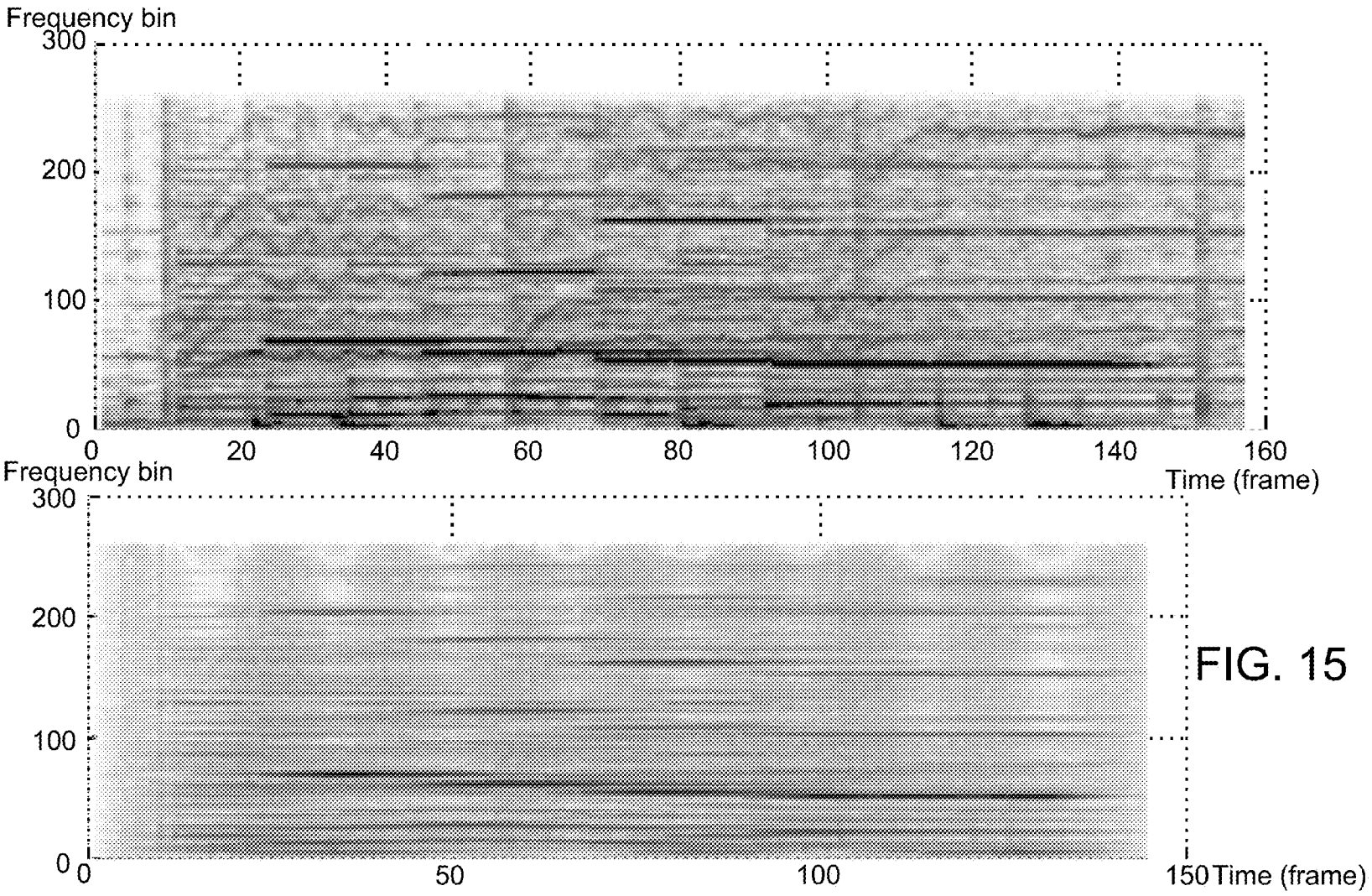
FIGS. 15 and 16 show before-and-after spectrograms.
Figure 16:
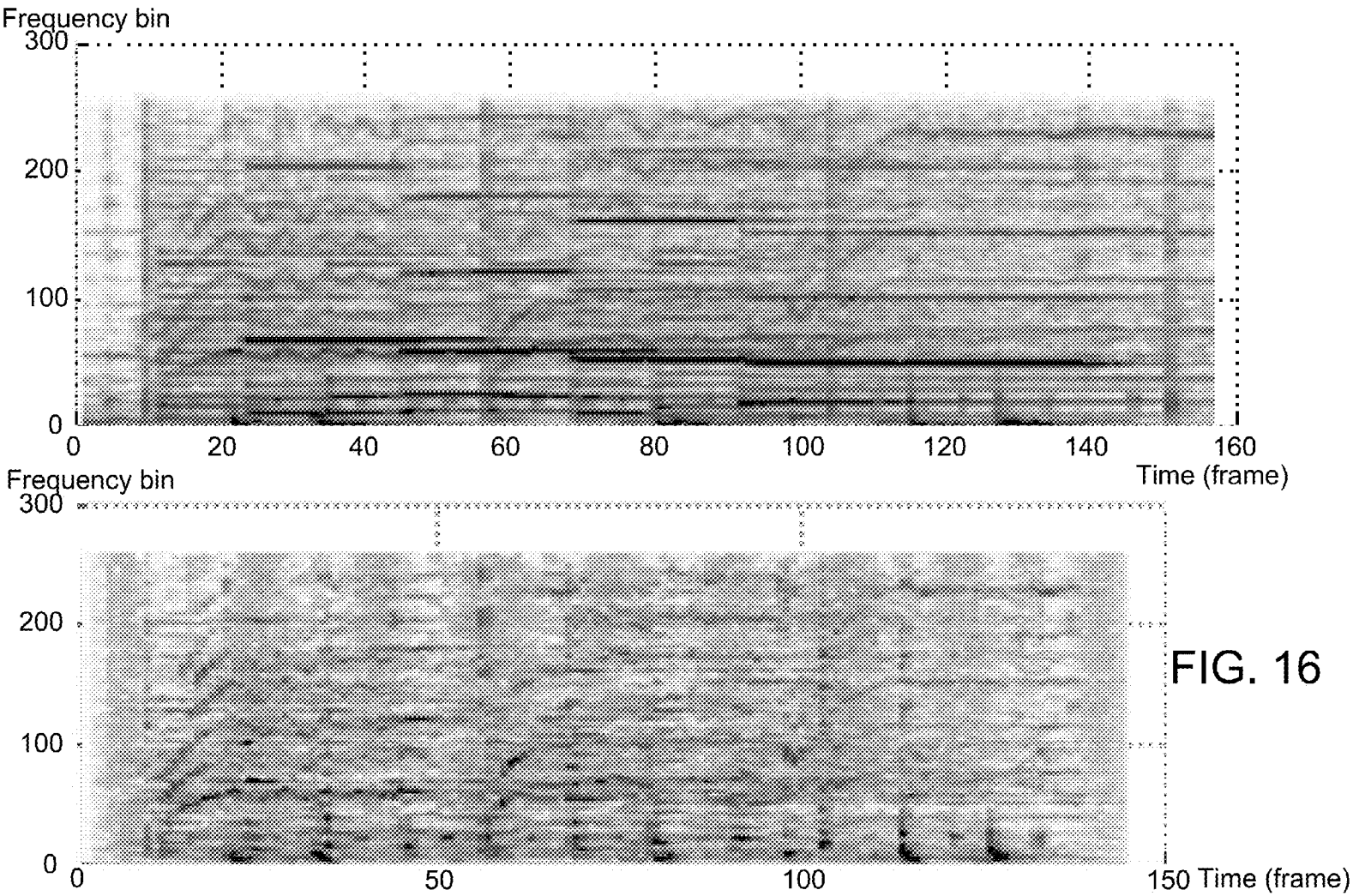

In a simple demonstration of such a method, we consider all bins as pitch candidates for the pitch inventory. In other words, a pitch candidate does not include any more harmonic bins except for the pitch bin. We consider the following function of the magnitude response of each subband as a time series: 20*log 10(abs(magnitude response)). FIG. 15 shows examples of spectrograms produced by tasks G50 (top) and GC30 (bottom) for such a case in which task GB20 is implemented to produce a filter that selects steady trajectories (e.g., a lowpass filter). FIG. 16 shows examples of spectrograms produced by tasks G50 (top) and GC30 (bottom), for the same mixture signal as in FIG. 15, for a case in which task GB20 is implemented to produce a filter that selects varying trajectories (e.g., a highpass filter). In these examples, task G50 performs a 256-point FFT on the time-domain mixture signal, and task GB10 performs a 16-point FFT on the subband-domain signal.

Figure 17:
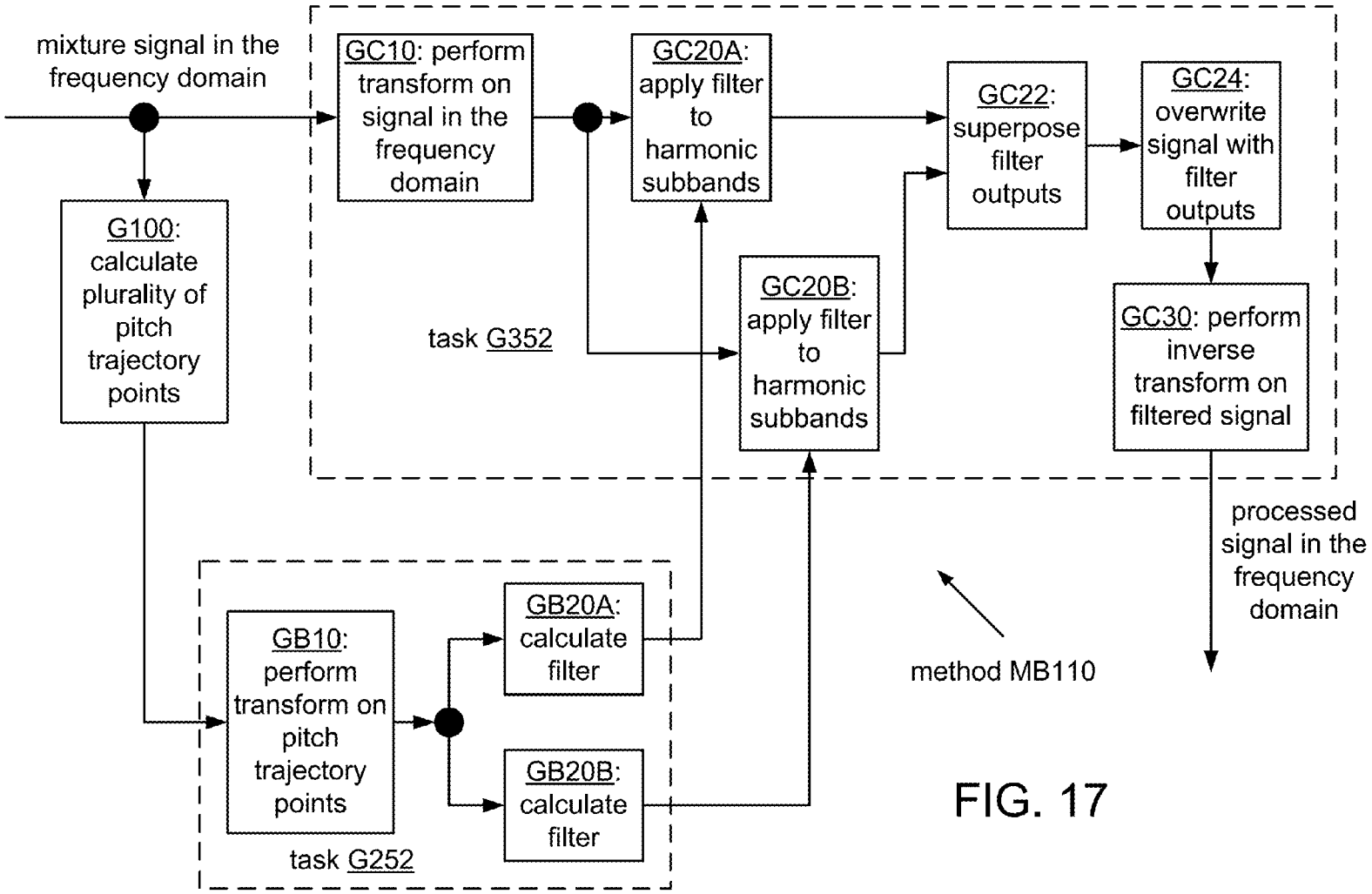
FIG. 17 shows a flowchart of an implementation MB110 of method MB100.

It may be desirable to implement task GC20 to superpose the filtered results, as some bins may be shared by multiple pitch components. For example, a component at a frequency of 440 Hz may be shared by a pitch component having a fundamental of 110 Hz and a pitch component having a fundamental of 220 Hz. FIG. 17 shows a flowchart of an implementation MB110 of method MB100 that includes implementations G252 and G352 of tasks G250 and G350, respectively. Task G252 includes two instances GB20A, GB20B of filter calculating task GB20 that are implemented to calculate filters for different respective harmonic components, which may coincide at one or more frequencies. Task G352 includes corresponding instances GC20A, GC20B of task GC20, which apply each of these filters to the corresponding harmonic bins. Task G352 also includes task GC22, which superposes (e.g., sums) the filter outputs, and task GC24, which writes the superposed filter outputs over the corresponding time-frequency points of the signal.

Figure 18:
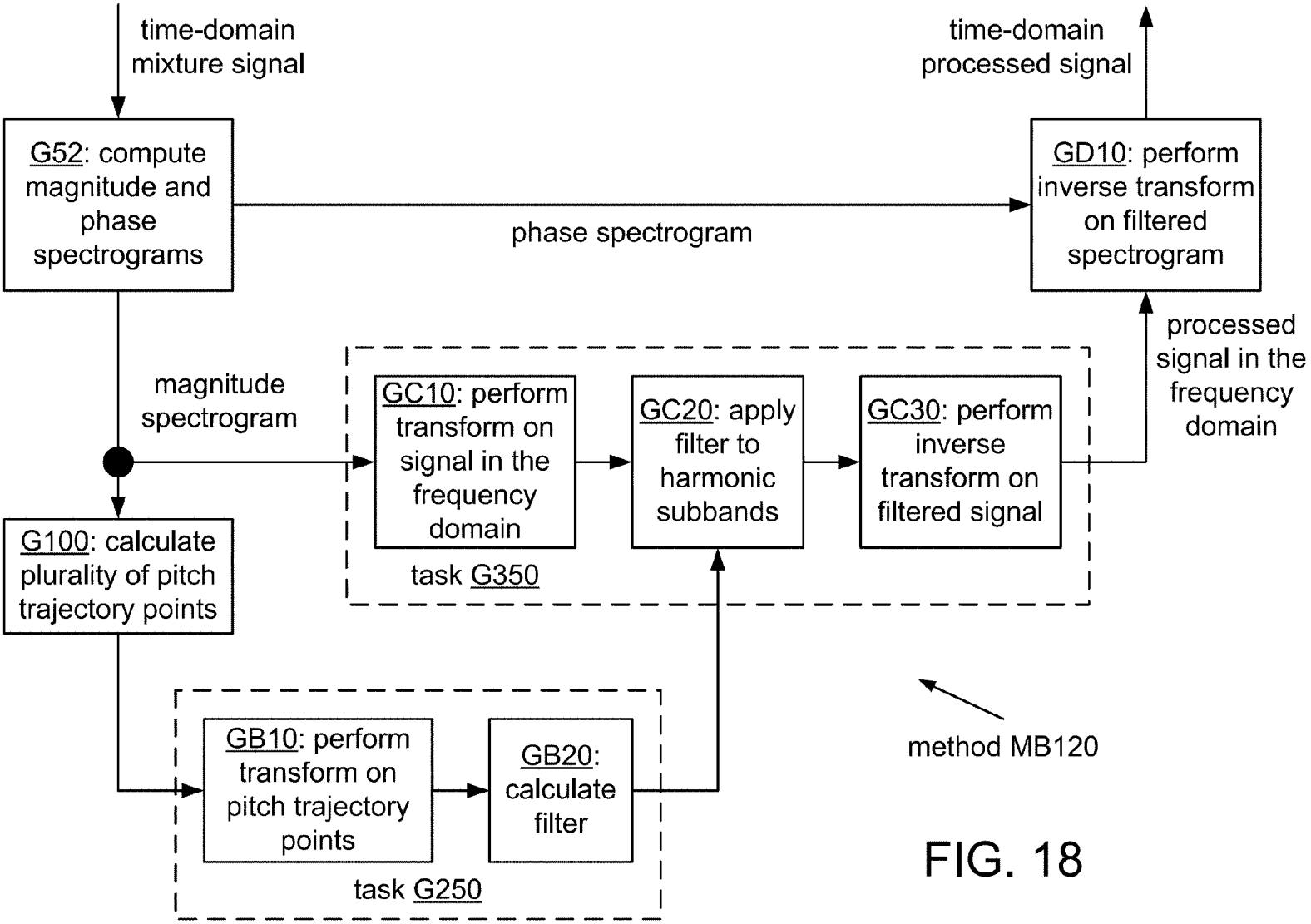
FIG. 18 shows a flowchart of an implementation MB120 of method MB100.

FIG. 18 shows a flowchart for an implementation MB 120 of method MB 100. Method MB200 includes an implementation G52 of task G50 that produces both magnitude and phase spectrograms from the mixture signal. Method MB200 also includes a task GD10 that performs an inverse transform on the filtered magnitude spectrogram and the original phase spectrogram to produce a time-domain processed signal having content according to the trajectory selected by task GB20.

Figure 19:
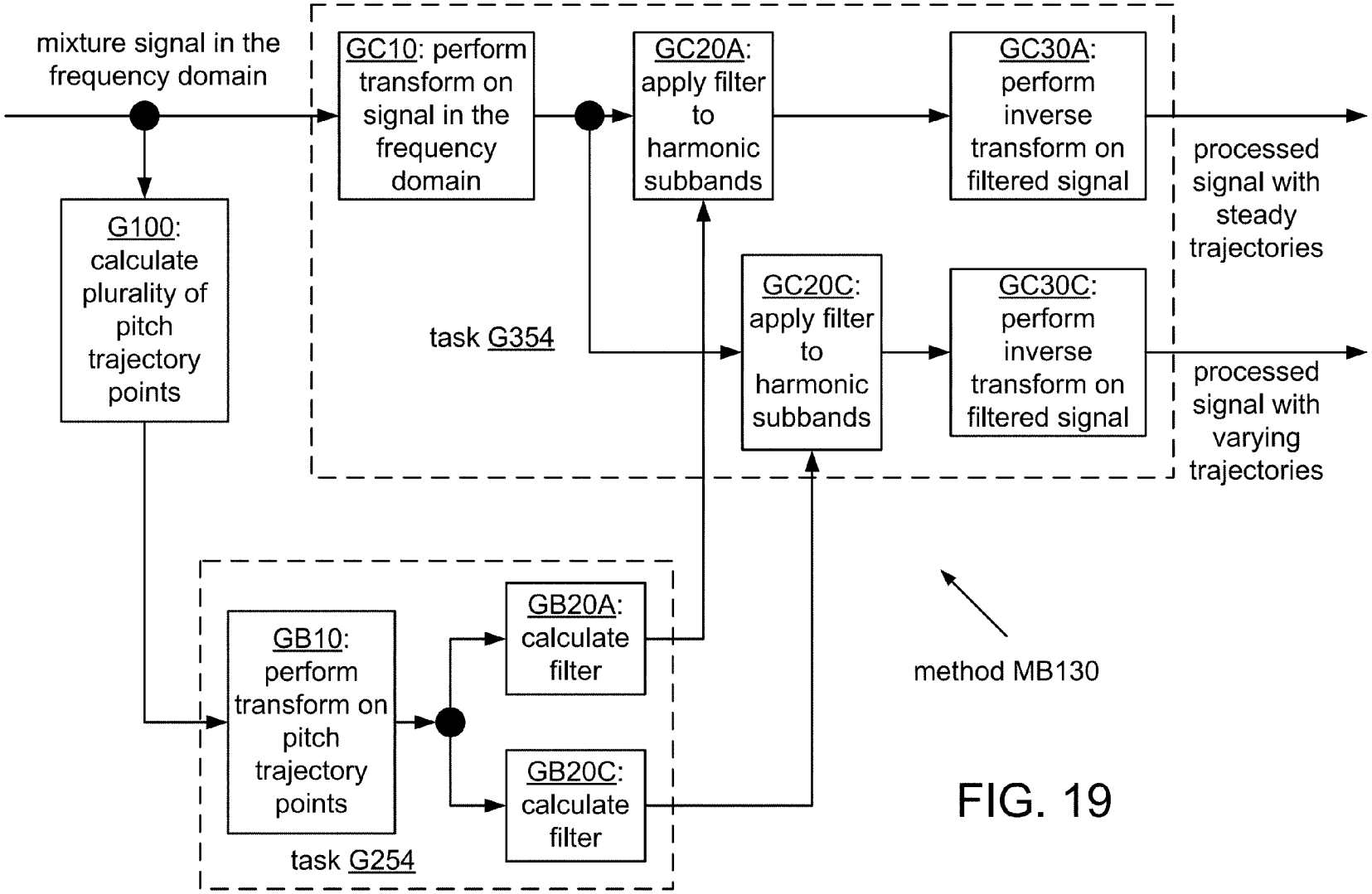
FIG. 19 shows a flowchart of an implementation MB130 of method MB100.

FIG. 19 shows a flowchart for an implementation MB130 of method MB100. Method MB130 includes an implementation G254 of task G252 that produces a filter to select steady trajectories and a filter to select varying trajectories, and an implementation G354 that produces corresponding processed signals PS10 and PV10.

Figure 20:
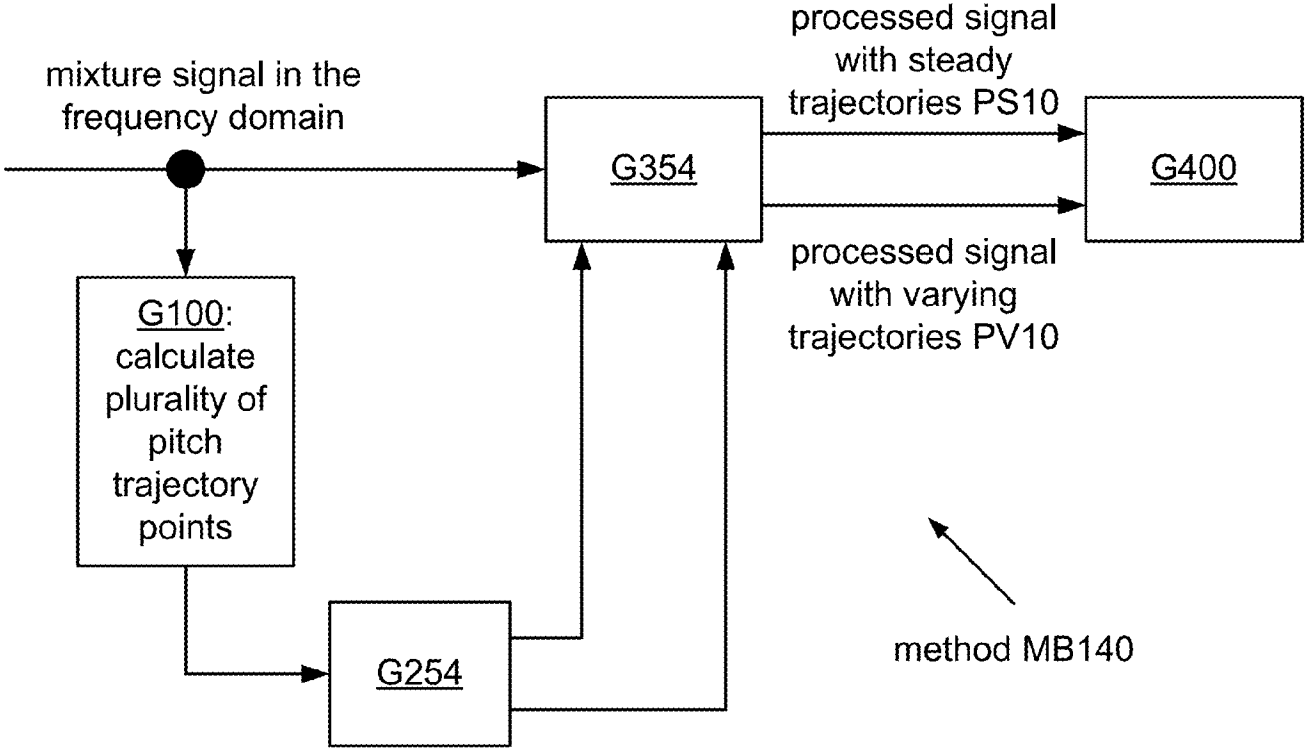
FIG. 20 shows a flowchart for an implementation MB140 of method MB100.
Figure 21:
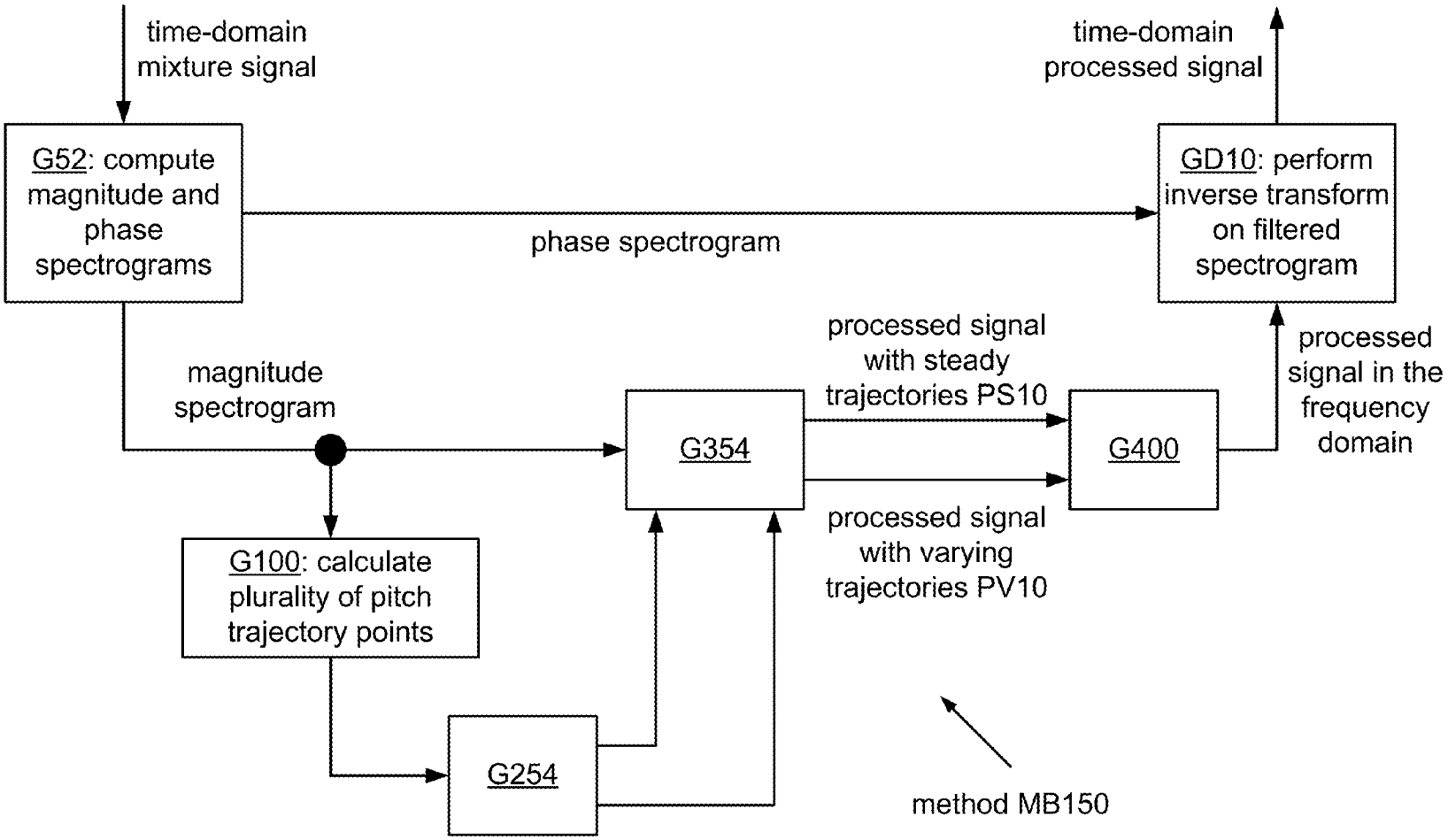
FIG. 21 shows a flowchart for an implementation MB150 of method MB140.

FIG. 20 shows a flowchart for an implementation MB140 of method MB130 that includes a task G400. Method MB300 also includes a task G400 that classifies components of the mixture signal, based on results of the trajectory analysis. For example, task G400 may be implemented to classify components as vocal or instrumental, to associate a component with a particular instrument, and/or to link a component having a steady trajectory with a component having a varying trajectory (e.g., linking segments that are piecewise in time). Such operations are described in more detail herein. Task G400 may also include one or more post-processing operations, such as smoothing. FIG. 21 shows a flowchart for an implementation MB150 of method MB140, which includes an instance of inverse transform task GD10 that is arranged to produce a time-domain signal based on a processed spectrogram produced by task G400 and the phase response of the original spectrogram.

Task G400 may be implemented, for example, to apply an instrument classification for a given frame and to reconstruct a spectrogram for desired instruments. Task G400 may be implemented to use a sequence of pitch-stable time-frequency points from signal PS10 to identify the instrument and its pitch component, based on a recovery framework such as, for example, a sparse recovery or NNMF scheme (as described, e.g., in US 2012/0101826 A1 and 2012/0128165 A1 cited above). Task G400 may also be implemented to search nearby in time and frequency among the varying (or "unstable") trajectories (e.g., as indicated by task G215 or GB20) to locate a pitch component with a similar formant structure of the desired instrument, and combine two parts if they belong to the desired instrument. It may be desirable to configure such a classifier to use previous frame information (e.g., a state space representation, such as Kalman filtering or hidden Markov model (HMM)).

Further refinements that may be included in method MB100 may include selective subband-domain (i.e., modulation-domain) filtering based on a priori knowledge such as, e.g., onset and/or offset of a component. For example, we can implement task GC20 to apply filtering after onset in order to preserve the onset part or percussive sound events, to apply filtering before offset in order to preserve the offset part, and/or to avoid applying filtering during onset and/or offset. Other refinements may include implementing tasks GB10, GC10, and GC30 to perform a variable-rate STFT (or other transform) on each subband. For example, depending on a musical characteristic such as tempo, we can select the FFT size for each subband and/or change the FFT size over time dynamically in accordance with tempo changes.

Figure 22:
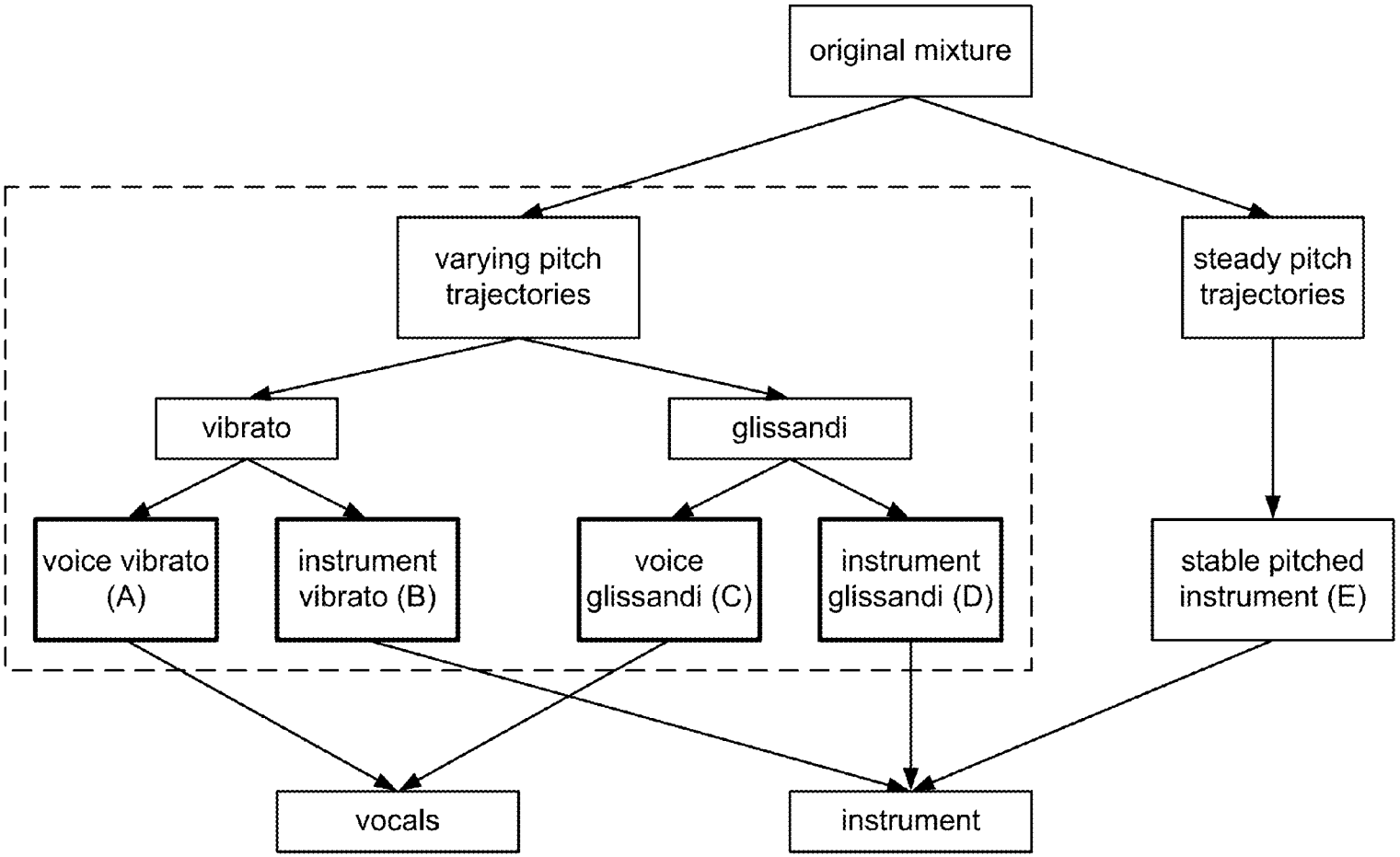
FIG. 22 shows an overview of a classification of components of a mixture signal.
Figure 23:
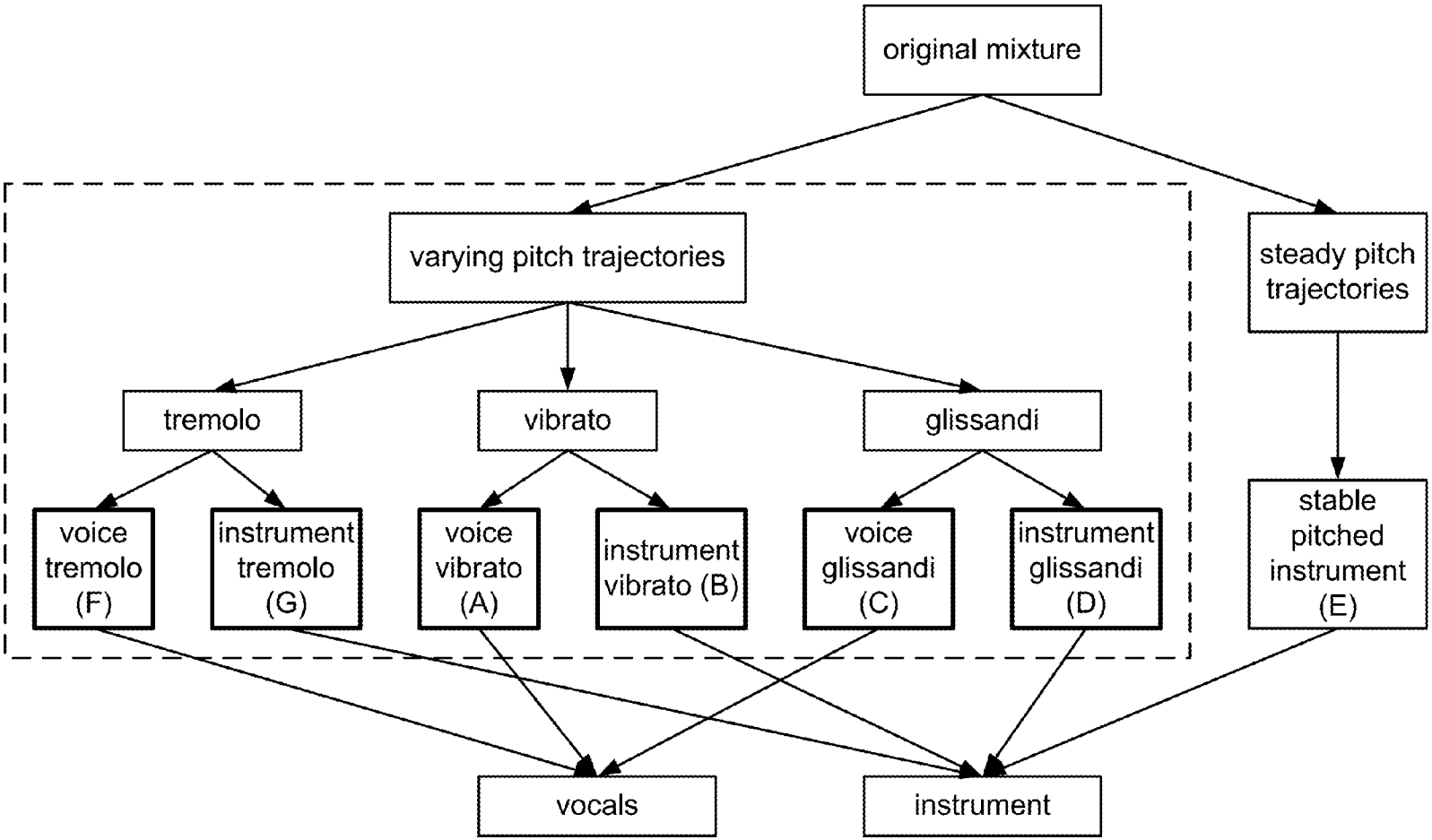
FIG. 23 shows an overview of another classification of components of a mixture signal.
Figure 27:
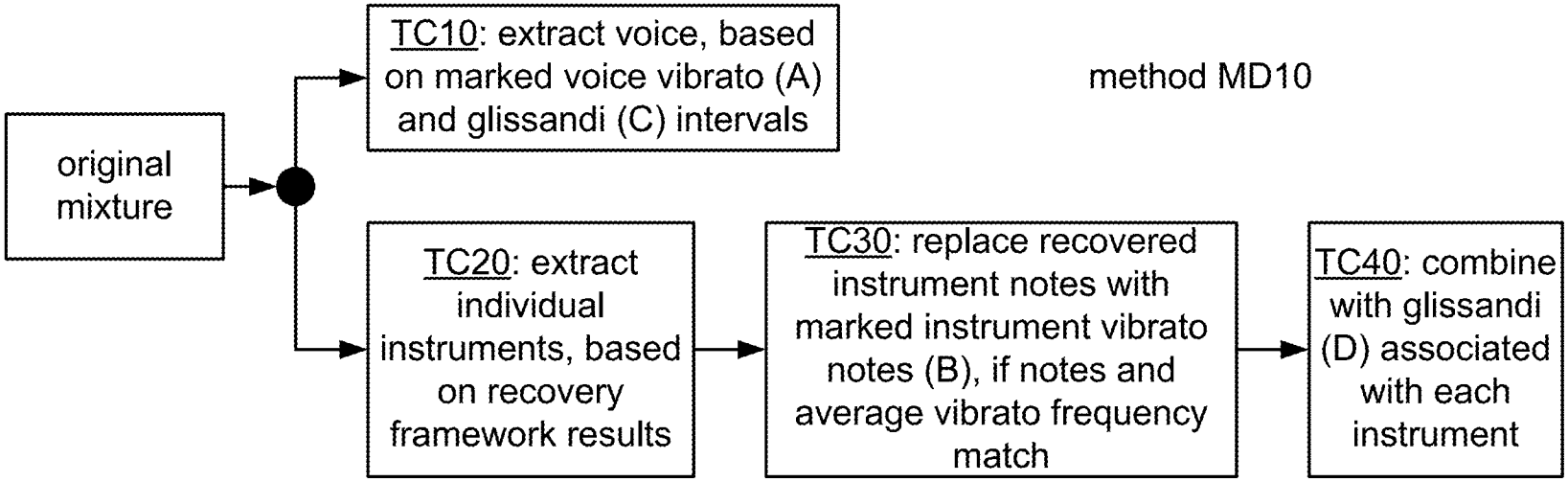
FIG. 27 shows a flowchart for a method MD10 that may be used to obtain a separation of the mixture signal.

FIG. 22 shows an overview of a classification of components of a mixture signal to separate vocal components from instrumental components. FIG. 23 shows an overview of a similar classification that also uses tremolo (e.g., an amplitude modulation coinciding with the trajectory) to discriminate among vocal and instrumental components. For example, vocal components typically include both tremolo and vibrato, while instrumental components typically do not. The stable pitched instrument component(s) (E) may be obtained as a product of task G300 (e.g., as a product of task G310 or GC30). Examples of other subprocesses that may be performed to obtain such a decomposition are illustrated in FIGS. 24A, 24B, and 27.

Figure 24A:
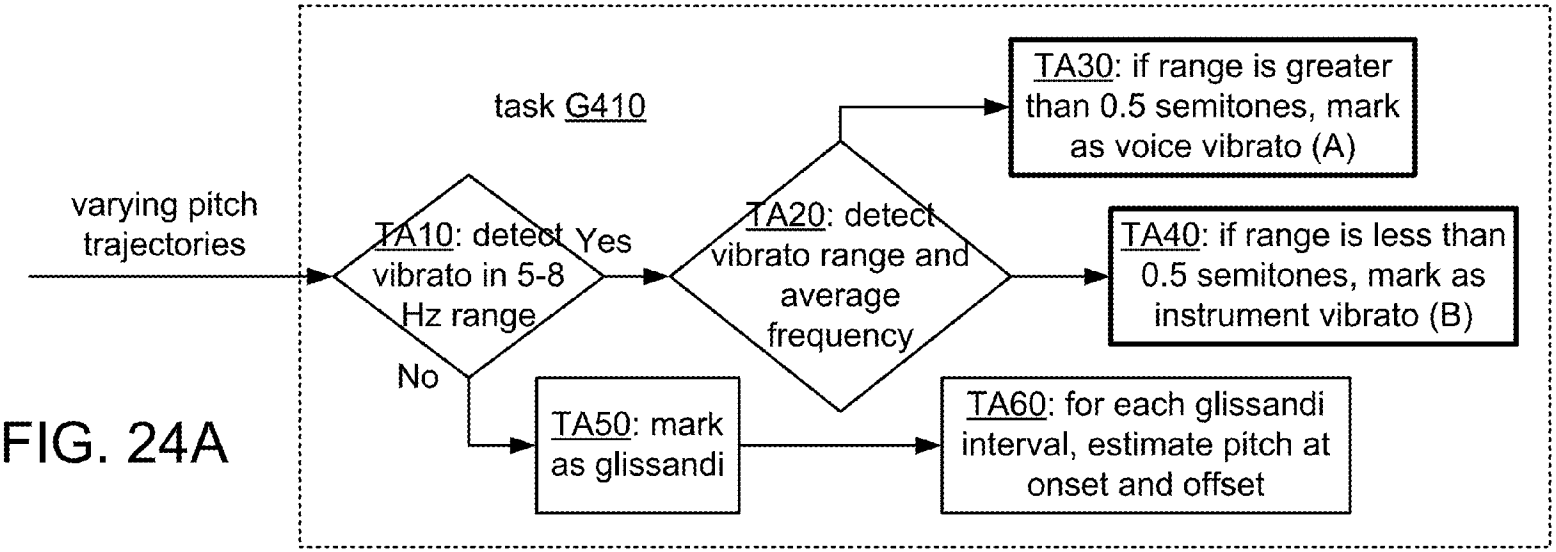
FIG. 24A shows a flowchart for an implementation G410 of task G400.

FIG. 24A shows a flowchart for an implementation G410 of task G400 that may be used to classify time-varying pitch trajectories (e.g., as indicated by task G215 or GB20). Task G410 includes subtasks TA10, TA20, TA30, TA40, TA50, and TA60. Task TA10 processes a varying trajectory to determine whether a pitch variation having a frequency of 5 to 8 Hz (e.g., vibrato) is present. If vibrato is detected, task TA20 calculates an average frequency of the trajectory and determines the range of pitch variation. If the range is greater than half of a semitone, task TA30 marks the trajectory as a voice vibrato (class (A) in FIG. 10). Otherwise, task TA40 marks the trajectory as an instrument vibrato (class (B) in FIG. 10). If vibrato is not detected, task TA50 marks the trajectory as a glissando, and task TA60 estimates the pitch at the onset of the trajectory and the pitch at the offset of the trajectory.

Figure 25:
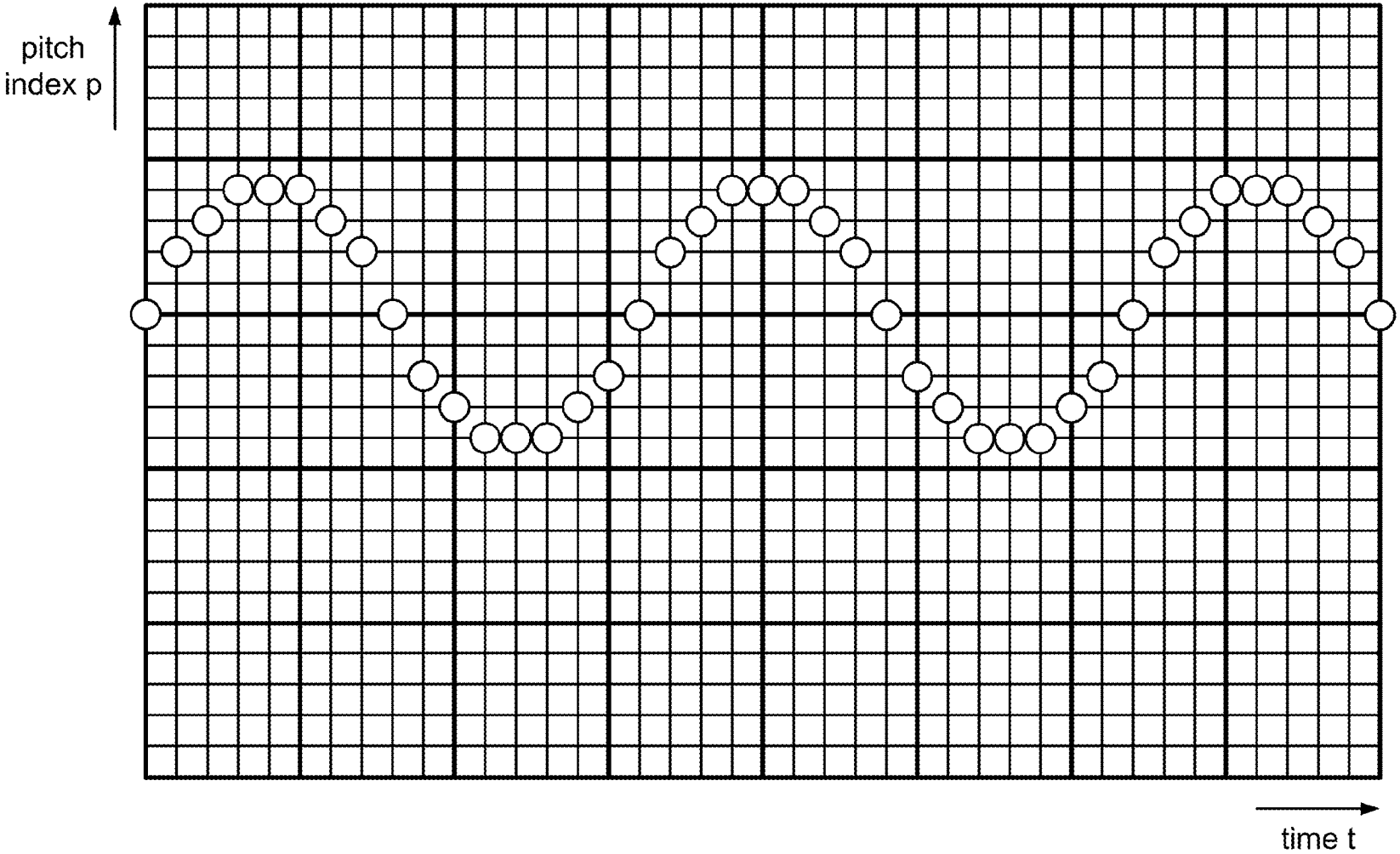
FIGS. 25 and 26 show examples of varying pitch trajectories.
Figure 26:
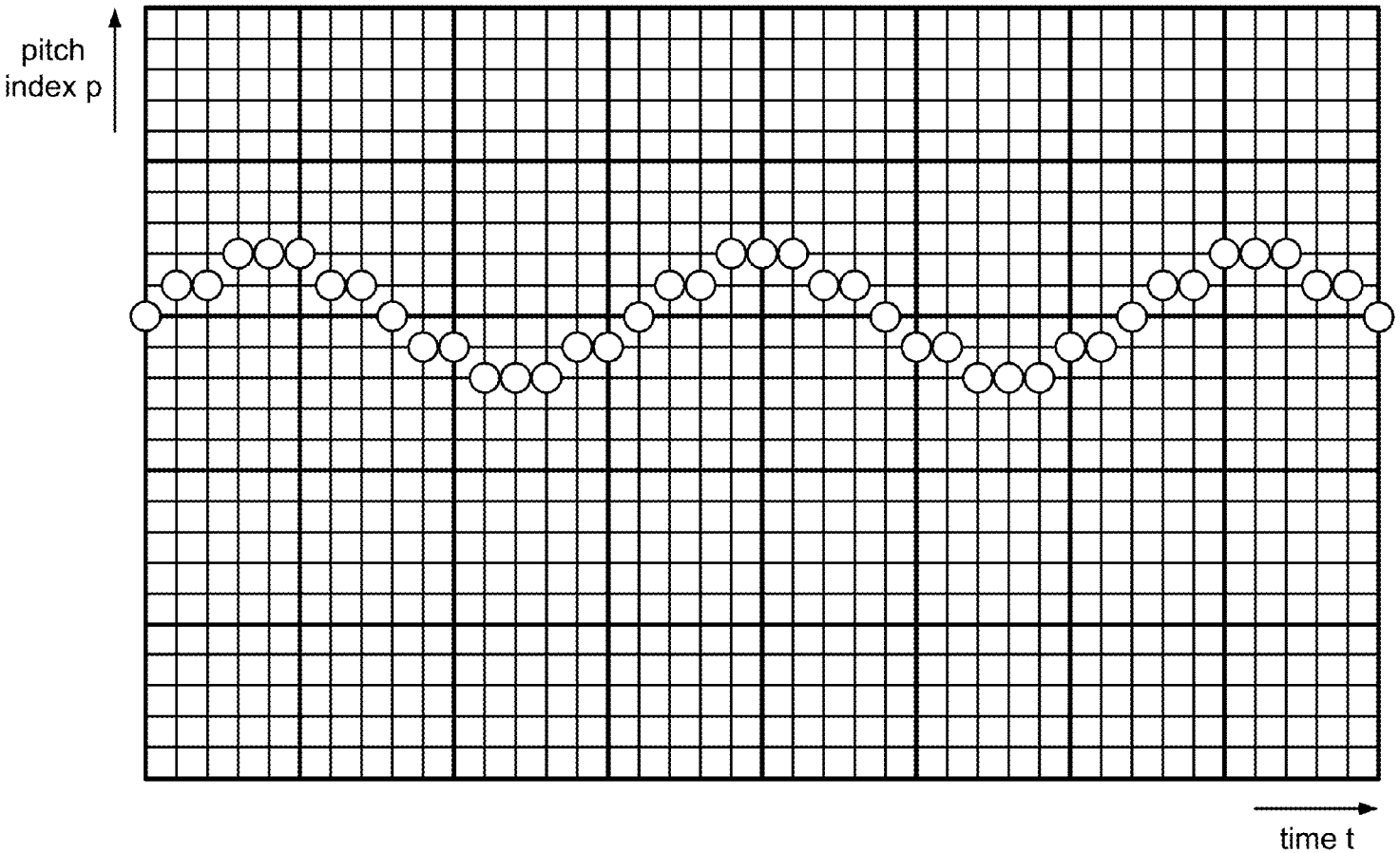

It is expressly noted that task G400 and implementations thereof (e.g., G410) may be used with processed signals produced by task G310 (e.g., from frequency analysis) or by GC30 (e.g., from gradient analysis). FIGS. 25 and 26 show example of labeled vibrato trajectories as produced by a gradient analysis implementation of task G300. In these figures, each vertical division indicates ten cents (i.e., one-tenth of a semitone). In FIG. 25, the vibrato range is +/−0.4 semitones, and the component is classified as vocal by task TA30. In FIG. 26, the vibrato range is +/−0.2 semitones, and the component is classified as instrumental by task TA40.

Figure 24B:
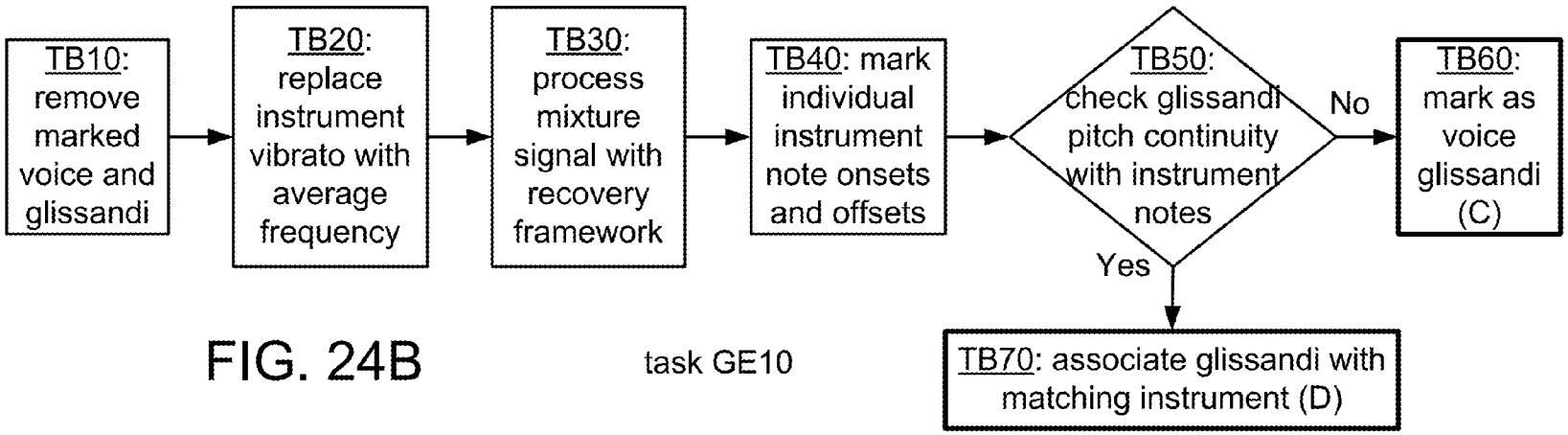
FIG. 24B shows a flowchart for a task GE10 that may be used to classify glissandi.

FIG. 24B shows a flowchart for a subtask GE10 of task G400 that may be used to classify glissandi. Task GE10 includes subtasks TB10, TB20, TB30, TB40, TB50, TB60, and TB70. Task TB10 removes voice (e.g., as marked by task TA30) and glissandi (e.g., as marked by task TA50) from the original spectrogram. Task TB10 may be performed, for example, by task G300 as described herein. Task TB20 removes instrument vibrato (e.g., as marked by task TA40) from the original spectrogram, replacing such components with corresponding harmonic components based on their average fundamental frequencies (e.g., as calculated by task TA20).

Task TB30 processes the modified spectrogram with a recovery framework to distinguish individual instrument components. Examples of such recovery frameworks include sparse recovery method (e.g., compressive sensing) and non-negative matrix factorization (NNMF). Note recovery may be performed using an inventory of basis functions that correspond to different instruments (e.g., different timbres). Examples of recovery frameworks that may be used are those described in, e.g., U.S. Publ. Pat. Appl. No. 2012/0101826 (application Ser. No. 13/280,295, publ. Apr. 26, 2012) and 2012/0128165 (application Ser. No. 13/280,309, publ. May 24, 2012), which documents are hereby incorporated by reference for purposes limited to disclosure of examples of recovery, using an inventory of basis functions, that may be performed by task G400, TB30, and/or H70.

Task TB40 marks the onset and offset times of the individual instrument note activations, and task TB50 compares the timing and pitches of these note activations with the timing and onset and offset pitches of the glissandi (e.g., as estimated by task TA60). If a glissando corresponds in time and pitch to a note activation, task TB70 associates the glissando with the matching instrument (class (D) in FIGS. 22 and 23). Otherwise, task TB60 marks the glissando as a voice glissando (class (C) in FIGS. 22 and 23).

FIG. 27 shows a flowchart for a method MD10 that may be used (e.g., by task G400) to obtain a separation of the mixture signal into vocal and instrument components. Based on the intervals marked as voice vibrato and glissandi (classes (A) and (C) in FIGS. 22 and 23), task TC10 extracts the vocal components of the mixture signal. Based on the decomposition results of the recovery framework (e.g., as produced by task TB30), task TC20 extracts the instrument components of the mixture signal. Task TC30 compares the timing and average frequencies of the marked instrument vibrato notes (class (B) in FIGS. 22 and 23) with the timing and pitches of the instrument components, and replaces matching components with the corresponding vibrato notes. Task TC40 combines these results with the instrument glissandi (class (D) in FIGS. 22 and 23) to complete the decomposition.

Another approach that may be used to obtain a vocal component having a time-varying pitch trajectory is to extract components having pitch trajectories that are stable over time (e.g., using a suitable configuration of method MB100 as described herein) and to combine these stable components with a noise reference (possibly including boosting the stable components to obtain the combination). A noise reduction method may then be performed on the mixture signal, using the combined noise reference, to attenuate the stable components and produce the vocal component. Examples of a suitable noise reference and noise reduction method are those described, for example, in U.S. Publ. Pat. Appl. No. 2012/0130713 A1 (Shin et al., publ. May 24, 2012).

During reconstruction, the problem of matching vibrato portions to their individual sources may arise. One approach is to refer to nearby notes given by stable pitch outputs (e.g., as obtained using non-negative matrix factorization (NNMF) or a similar recovery framework). Another approach is to train classifiers of vibrato (or glissando) using features of vibrato rate/extent and amplitude. Examples of such classifiers include, without limitation, Gaussian mixture model (GMM), hidden Markov model (HMM), and support vector machine (SVM) classifiers. The document "Vibrato: Questions and Answers from Musicians and Science" (R. Timmers et al., Proc. Sixth ICMPC, Keele, 2000) shows some data analysis results of a relationship between musical instruments and note features (loudness, mean vibrato rate, and mean vibrato extent).

As noted above, vibrato may interfere with a note recovery operation or otherwise act as a disturbance. Methods as described above may be used to detect the vibrato, and to replace the spectrogram with one without vibrato. In other circumstances, however, vibrato may indicate useful information. For example, it may be desirable to use vibrato information for discrimination.

Vibrato is considered as a disturbance for NMF/sparse recovery, and methods for removing and restoring such components are discussed above. In a sparse recovery or NMF note recovery stage, for example, it may be desirable to exclude the bases with vibrato. However, vibrato also contains unique information that may be used, for example, for instrument recognition and/or to update one or more of the recovery basis functions. Information useful for instrument recognition may include vibrato rate/extent and amplitude (as described above) and/or timbre information extracted from vibrato part. Alternatively or additionally, it may be desirable to use timbre information extracted from vibrato components to update the bases for a note recovery operation (e.g., NMF or sparse recovery). Such updating may be beneficial, for example, when the bases and the recorded instrument are mismatched. A mapping from the vibrato timbre to stationary timbre (e.g., as trained from a database of many instruments recorded with and without vibrato) may be useful for such updating.

Figure 28:
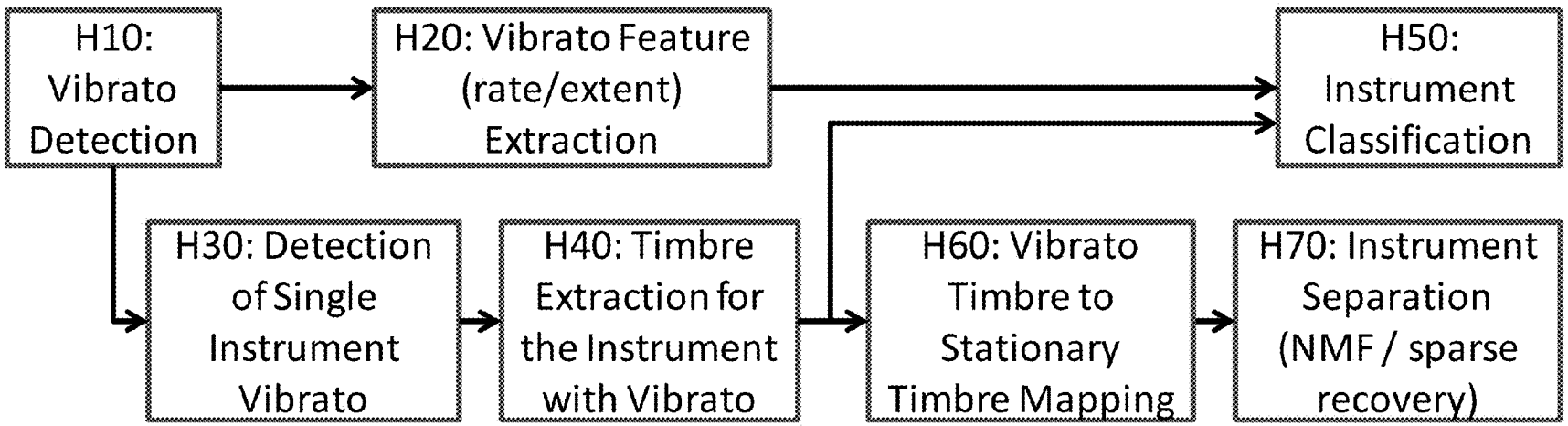
FIG. 28 shows a flowchart for a method ME10 of applying information extracted from vibrato components according to a general configuration.

FIG. 28 shows a flowchart for a method ME10 of using vibrato information that includes tasks H10, H20, H30, H40, H50, H60, and H70 and may be included within, for example, task G400. Task H10 performs vibrato detection (e.g., as described above with reference to task TA10). Task H20 extracts features (e.g., rate, extent, and/or amplitude) from the vibrato component (e.g., as described above with reference to task TA10).

Task H30 indicates whether single-instrument vibrato is present. For example, task H30 may be implemented to track the fundamental/harmonic frequency trajectory to determine if it is a single vibrato or a superposition of multiple vibratos. Multiple vibratos means that several instruments have vibrato at the same time, especially when they play the same note. Strings may be a little bit different, as a number of string instruments playing together.

Task H30 may be implemented to determine whether a trajectory is a single vibrato or multiple vibratos in any of several ways. In one example, task H30 is implemented to track spectral peaks within the range of the given note, and to measure the number of peaks and the widths of the peaks. In another example, task H30 is implemented to use the smoothed time trajectory of the peak frequency within the note range to obtain a test statistic, such as zero crossing rate of the first derivative (e.g., the number of local minima and maxima) compared with the dominant frequency of the trajectory (which corresponds to the largest vibrato).

The timbre of an instrument in the training data (i.e., the data that was used to construct the bases) can be different from the timbre of the recorded instrument in the mixture signal. It is tricky to determine the exact timbre of the current instrument (i.e., relative strengths of harmonics). During vibrato, however, it may be expected that the harmonic components and the fundamental will have a synchronized vibration, and this effect may be used to accurately extract the timbre of a played instrument (e.g., by identifying components of the mixture signal whose pitch trajectories are synchronized in time). Task H40 performs timbre extraction for the instrument with vibrato. Task H40 may include isolating the spectrum from the instrument vibrato in the vibrato part, which helps to extract the timbre of the currently recorded instrument. Task H40 may be used, for example, to implement task TB20 as described above.

Task H50 performs instrument classification (e.g., discrimination of vocal and instrumental components), based on the extracted vibrato features and the extracted vibrato timbre (e.g., as described herein with reference to task TB30).

The timbre as extracted from a recording of an instrument with single vibrato may not be exactly the same as the timbre of the same instrument when the player does not use vibrato. For instruments whose stationary timbre differs from the timbre with vibrato, it may be desirable to map the vibrato timbre to the stationary timbre before updating the basis functions. A relation between the timbres with and without vibrato of the same instrument may be extracted from the data of many instruments with and without vibrato (e.g., by a training operation). Such a mapping, which may alter the relative weights of the elements of one or more of the basis functions, may differ from one class of instruments (e.g., strings) to another (e.g., woodwinds) and/or between instruments and vocals. It may be desirable to apply such an additional mapping to compensate the difference between the timbre with vibrato and timbre without vibrato. Task H60 performs such a mapping from a vibrato timbre to a stationary timbre.

Task H70 performs instrument separation. For example, task H70 may use a recovery framework to distinguish individual instrument components (e.g., using a sparse recovery method or an NNMF method, as described herein). For sparse recovery based on a basis function inventory, task H70 may also be implemented to use the extracted timbre information (e.g., after mapping from vibrato timbre to stationary timbre) to update corresponding basis functions of the inventory. Such updating may be beneficial especially when the timbres in the mixture signal differ from the initial basis functions in the inventory.

Figure 29C:
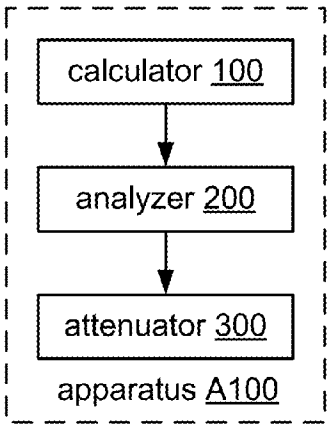
FIG. 29C shows a block diagram of an apparatus A100 according to a general configuration.
Figure 29B:
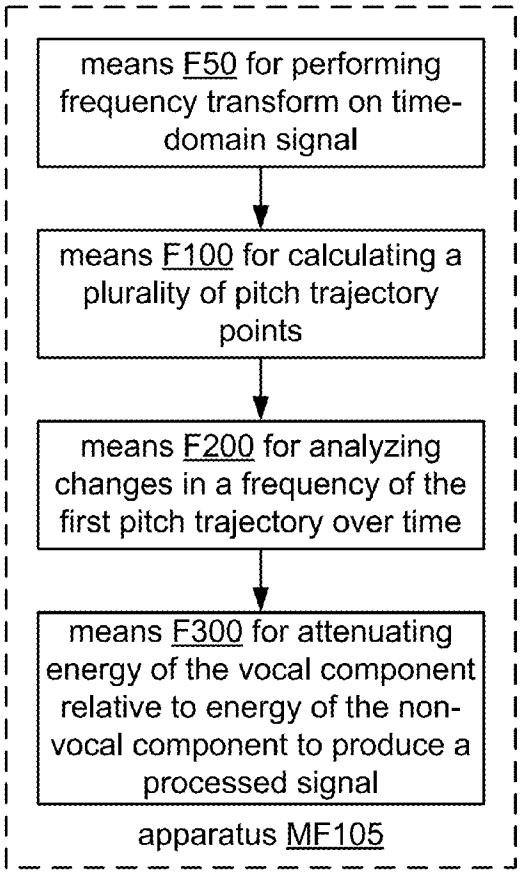
FIG. 29B shows a block diagram of an implementation MF105 of apparatus MF100.
Figure 29A:
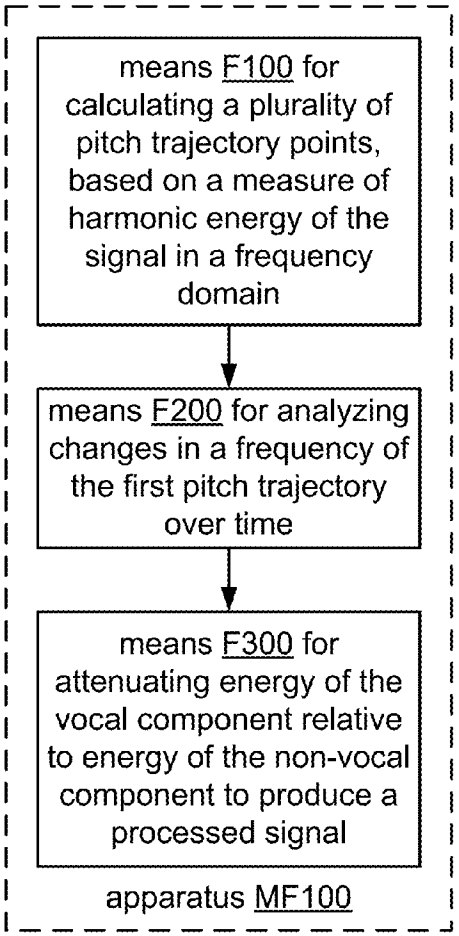
FIG. 29A shows a block diagram of an apparatus MF100 according to a general configuration.

FIG. 29A shows a block diagram of an apparatus MF100, according to a general configuration, for processing a signal that includes a vocal component and a non-vocal component. Apparatus MF100 includes means F100 for calculating a plurality of pitch trajectory points, based on a measure of harmonic energy of the signal in a frequency domain (e.g., as described herein with reference to implementations of task G100). The plurality of pitch trajectory points includes a plurality of points of a first pitch trajectory of the vocal component and a plurality of points of a second pitch trajectory of the non-vocal component. Apparatus MF100 also includes means F200 for analyzing changes in a frequency of the first pitch trajectory over time (e.g., as described herein with reference to implementations of task G200). Apparatus MF100 also includes means F300 for attenuating energy of the vocal component relative to energy of the non-vocal component to produce a processed signal, based on a result of said analyzing (e.g., as described herein with reference to implementations of task G300). FIG. 29B shows a block diagram of an implementation MF105 of apparatus MF100 that includes means F50 for performing a frequency transform on the time-domain signal (e.g., as described herein with reference to implementations of task G50).

FIG. 29C shows a block diagram of an apparatus A100, according to a general configuration, for processing a signal that includes a vocal component and a non-vocal component. Apparatus A100 includes a calculator 100 configured to calculate a plurality of pitch trajectory points, based on a measure of harmonic energy of the signal in a frequency domain (e.g., as described herein with reference to implementations of task G100). The plurality of pitch trajectory points includes a plurality of points of a first pitch trajectory of the vocal component and a plurality of points of a second pitch trajectory of the non-vocal component. Apparatus A100 also includes an analyzer 200 configured to analyze changes in a frequency of the first pitch trajectory over time (e.g., as described herein with reference to implementations of task G200). Apparatus A100 also includes an attenuator 300 configured to attenuate energy of the vocal component relative to energy of the non-vocal component to produce a processed signal, based on a result of said analyzing (e.g., as described herein with reference to implementations of task G300).

Figure 30A:
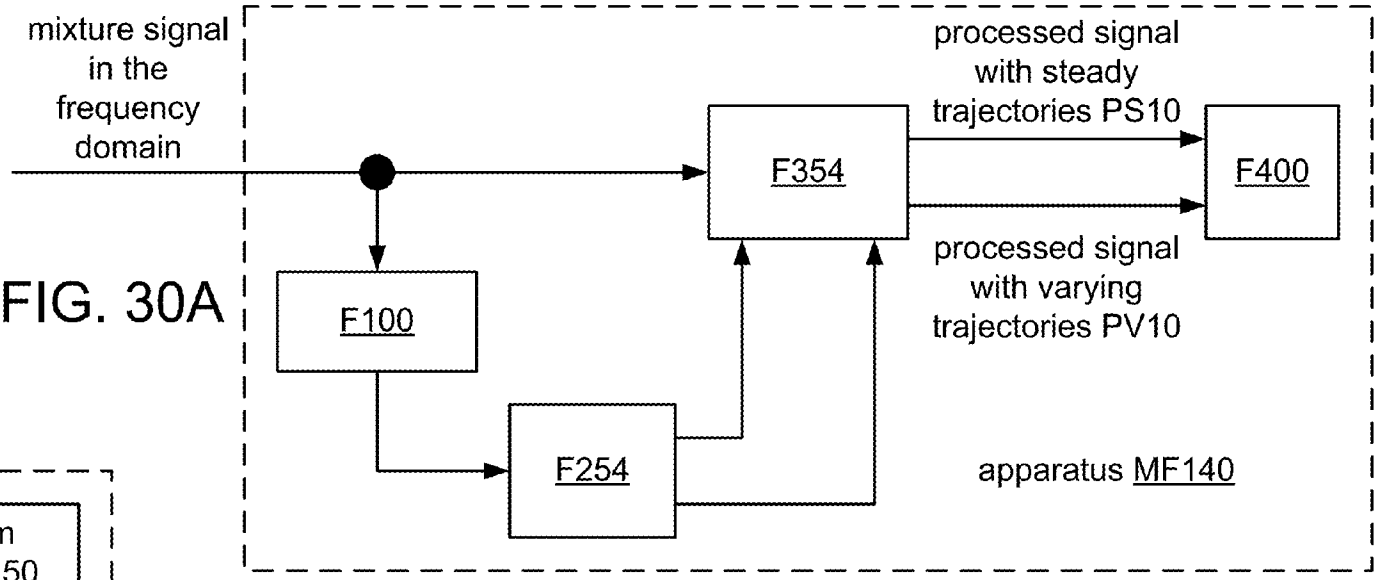
FIG. 30A shows a block diagram of an implementation MF140 of apparatus MF100.

FIG. 30A shows a block diagram of an implementation MF140 of apparatus MF100 in which means F200 is implemented as means F254 for producing a filter to select time-varying trajectories and a filter to select stable trajectories (e.g., as described herein with reference to implementations of task G254). In apparatus MF140, means F300 is implemented as means F354 for producing processed signals (e.g., as described herein with reference to implementations of task G354). Apparatus MF140 also includes means F400 for classifying components of the signal (e.g., as described herein with reference to implementations of task G400).

Figure 30B:
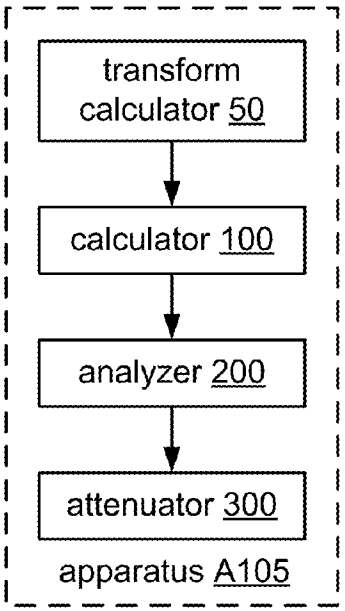
FIG. 30B shows a block diagram of an implementation A105 of apparatus A100.

FIG. 30B shows a block diagram of an implementation A105 of apparatus A100 that includes a transform calculator 50 configured to perform a frequency transform on the time-domain signal (e.g., as described herein with reference to implementations of task G50).

Figure 30C:
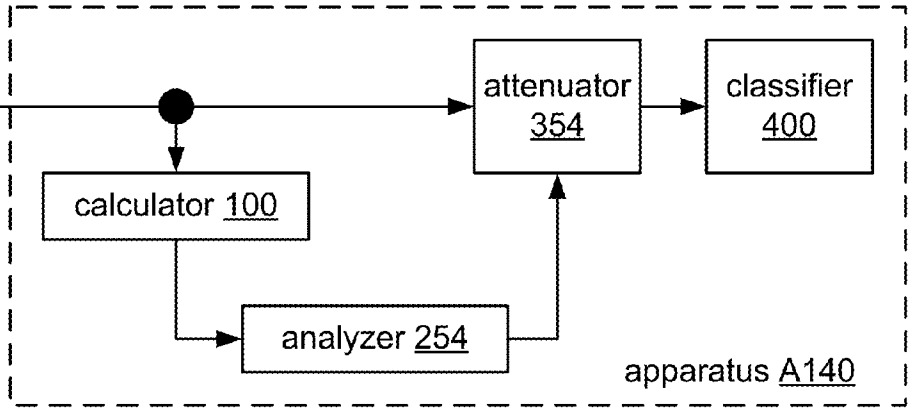
FIG. 30C shows a block diagram of an implementation A140 of apparatus A100.

FIG. 30C shows a block diagram of an implementation A140 of apparatus A100 that includes an implementation 254 of analyzer 200 that is configured to produce a filter to select time-varying trajectories and a filter to select stable trajectories (e.g., as described herein with reference to implementations of task G254). Apparatus A140 also includes an implementation 354 of attenuator 300 that is configured to produce processed signals (e.g., as described herein with reference to implementations of task G354). Apparatus A140 also includes a classifier 400 configured to classify components of the signal (e.g., as described herein with reference to implementations of task G400).

Figure 31:
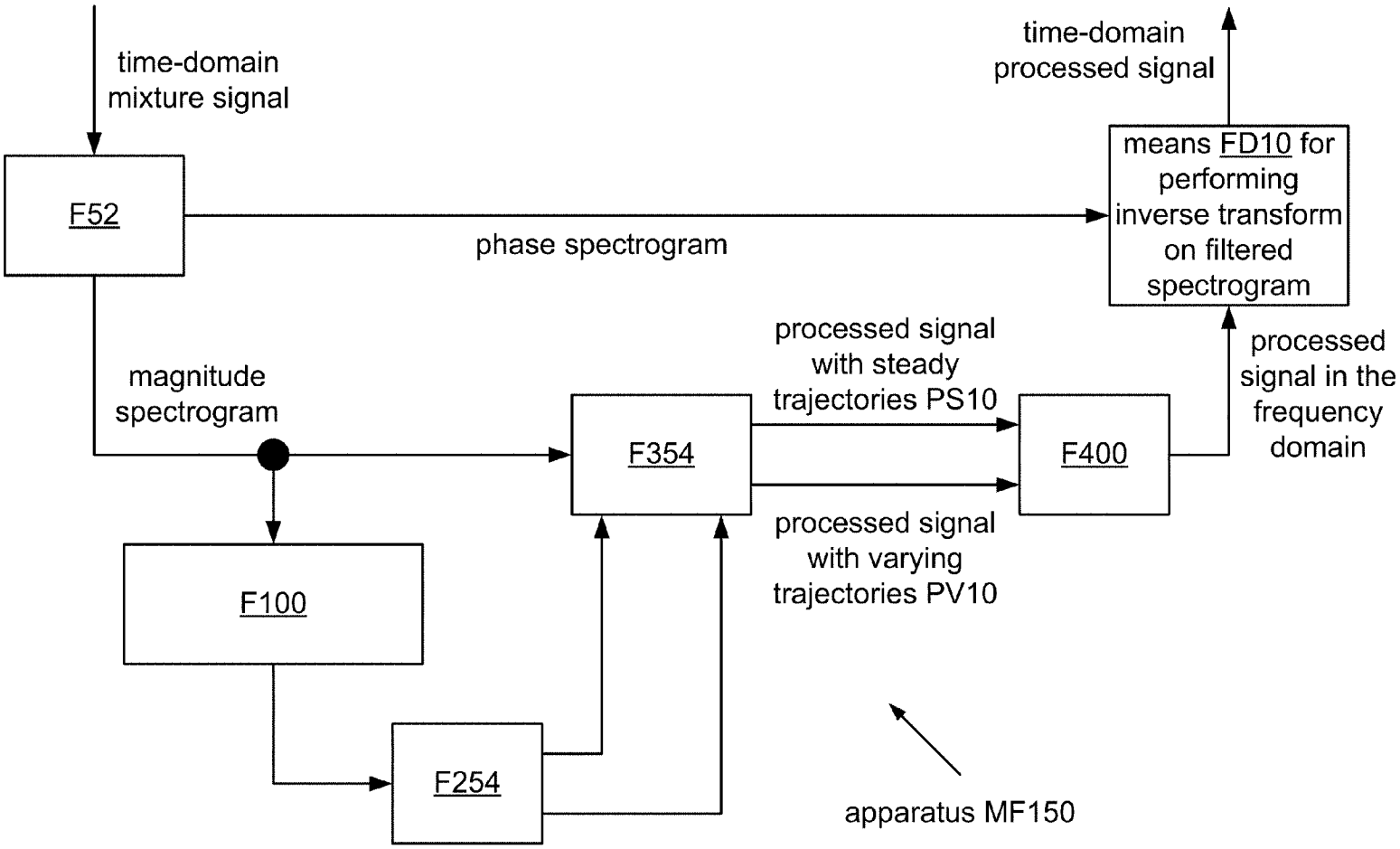
FIG. 31 shows a block diagram of an implementation MF150 of apparatus MF140.

FIG. 31 shows a block diagram of an implementation MF150 of apparatus MF140 in which means F50 is implemented as means F52 for producing magnitude and phase spectrograms (e.g., as described herein with reference to implementations of task G52). Apparatus MF150 also includes means FD10 for performing an inverse transform on a filtered spectrogram produced by means F400 (e.g., as described herein with reference to implementations of task GD10).

Figure 32:
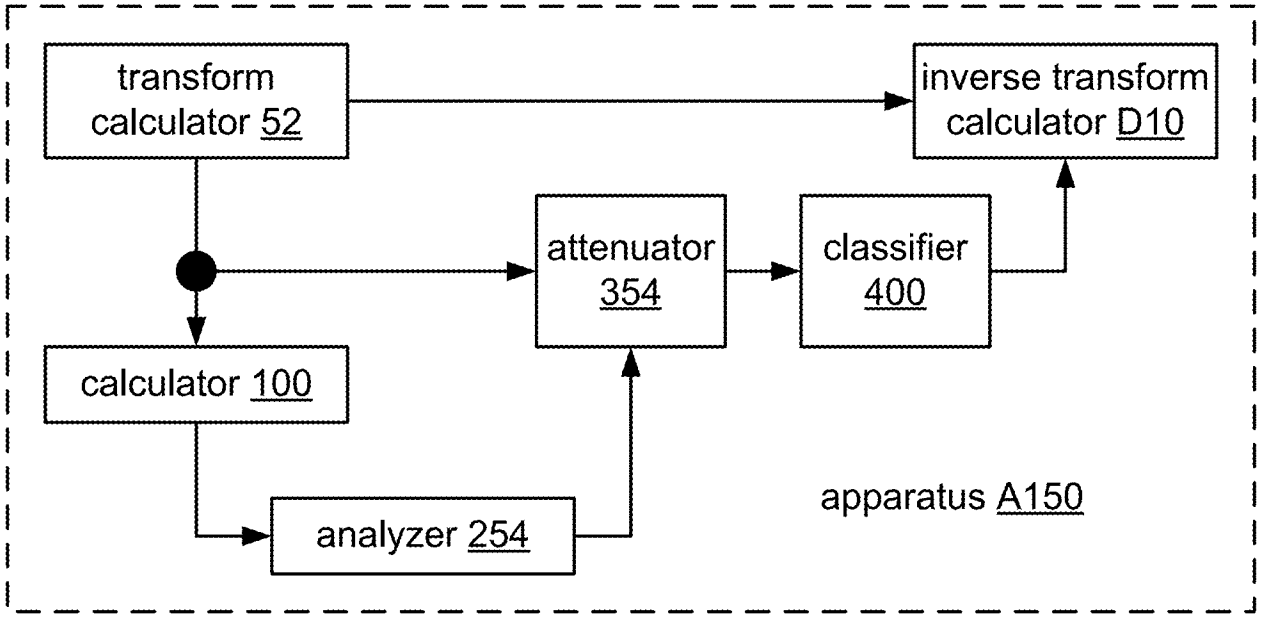
FIG. 32 shows a block diagram of an implementation A150 of apparatus A140.

FIG. 32 shows a block diagram of an implementation A150 of apparatus A140 that includes an implementation 52 of transform calculator 50 that is configured to produce magnitude and phase spectrograms (e.g., as described herein with reference to implementations of task G52). Apparatus A150 also includes an inverse transform calculator D10 configured to perform an inverse transform on a filtered spectrogram produced by classifier 400 (e.g., as described herein with reference to implementations of task GD10).

The presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 32, 44.1, 48, or 192 kHz).

An apparatus as disclosed herein (e.g., any device configured to perform a technique as described herein) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein may be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of the audio signal processing method, such as a task relating to another operation of a device or system in which the processor is embedded (e.g., an audio sensing device). It is also possible for part of a method as disclosed herein to be performed by a processor of the audio signal processing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk or any other medium which can be used to store the desired information, a fiber optic medium, a radio frequency (RF) link, or any other medium which can be used to carry the desired information and can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of processing a signal that includes a vocal component and a non-vocal component, said method performed by an apparatus, said method comprising:

based on a measure of harmonic energy of the signal in a frequency domain, calculating a plurality of pitch trajectory points, wherein said calculating a plurality of pitch trajectory points includes calculating a value of the measure of harmonic energy for each of a plurality of harmonic basis functions, wherein said plurality includes a plurality of points of a first pitch trajectory of the vocal component and a plurality of points of a second pitch trajectory of the non-vocal component;

analyzing changes in a frequency of said first pitch trajectory over time, wherein said analyzing changes comprises measuring a plurality of gradients for each value of the measure of harmonic energy that exceeds a threshold; and based on a result of said analyzing, attenuating energy of the vocal component relative to energy of the non-vocal component to produce a processed signal.

2. A method of signal processing according to claim 1, wherein each harmonic basis function among the plurality of harmonic basis functions corresponds to a different fundamental frequency.

3. A method of signal processing according to claim 1, wherein said calculating a value of the measure of harmonic energy for each of the plurality of harmonic basis functions includes projecting the signal onto a column space of the plurality of harmonic basis functions.

4. A method of signal processing according to claim 1, wherein said attenuating is based on a change in frequency between points of the first pitch trajectory that are adjacent in time.

5. A method of signal processing according to claim 1, wherein said analyzing includes detecting a difference, in a frequency dimension, between points of the first pitch trajectory that are adjacent in time.

6. A method of signal processing according to claim 1, wherein said analyzing includes calculating a difference, in a frequency dimension, between points of the first pitch trajectory that are adjacent in time.

7. A method of signal processing according to claim 1, wherein said attenuating includes, for each of a plurality of frequency subbands of the signal, performing a frequency transform on the subband to obtain a vector in a modulation domain, and applying a filter to the vector.

8. A method of signal processing according to claim 1, wherein said method comprises, for each of a plurality of frequency subbands of the plurality of pitch trajectory points, performing a frequency transform on the subband to obtain a corresponding trajectory vector in a modulation domain.

9. A method of signal processing according to claim 8, wherein said method comprises:

based on information from at least one of said plurality of trajectory vectors, calculating a filter in the modulation domain;

for each of a plurality of frequency subbands of the signal in the frequency domain, performing a frequency transform on the subband to obtain a corresponding signal vector in a modulation domain; and applying the calculated filter to each of a plurality of the signal vectors.

10. A method of signal processing according to claim 1, wherein said method includes:

based on information from the processed signal, extracting a timbre corresponding to a time-varying pitch trajectory of the signal; and mapping the extracted timbre to a stationary timbre.

11. A method of signal processing according to claim 1, wherein said method includes, based on the result of said analyzing, locating a vibrato component of the signal, and wherein said attenuating includes attenuating said vibrato component.

12. A method of signal processing according to claim 1, wherein said method includes, based on the result of said analyzing, associating an offset of a stable pitch trajectory of the signal with an onset of a time-varying pitch trajectory of the signal.

13. A method of signal processing according to claim 1, wherein said method comprises applying an inventory of basis functions to the processed signal to extract at least one instrumental component.

14. An apparatus for processing a signal that includes a vocal component and a non-vocal component, said apparatus comprising:

means for calculating a plurality of pitch trajectory points that are based on a measure of harmonic energy of the signal in a frequency domain, wherein said means for calculating a plurality of pitch trajectory points includes means for calculating a value of the measure of harmonic energy for each of a plurality of harmonic basis functions, wherein said plurality includes a plurality of points of a first pitch trajectory of the vocal component and a plurality of points of a second pitch trajectory of the non-vocal component;

means for analyzing changes in a frequency of said first pitch trajectory over time, wherein said means for analyzing changes comprises means for measuring a plurality of gradients for each value of the measure of harmonic energy that exceeds a threshold; and means for attenuating energy of the vocal component relative to energy of the non-vocal component, based on a result of said analyzing, to produce a processed signal.

15. An apparatus for signal processing according to claim 14, wherein each harmonic basis function among the plurality of harmonic basis functions corresponds to a different fundamental frequency.

16. An apparatus for signal processing according to claim 14, wherein said calculating a value of the measure of harmonic energy for each of the plurality of harmonic basis functions includes projecting the signal onto a column space of the plurality of harmonic basis functions.

17. An apparatus for signal processing according to claim 14, wherein said attenuating is based on a change in frequency between points of the first pitch trajectory that are adjacent in time.

18. An apparatus for signal processing according to claim 14, wherein said analyzing includes detecting a difference, in a frequency dimension, between points of the first pitch trajectory that are adjacent in time.

19. An apparatus for signal processing according to claim 14, wherein said analyzing includes calculating a difference, in a frequency dimension, between points of the first pitch trajectory that are adjacent in time.

20. An apparatus for signal processing according to claim 14, wherein said attenuating includes, for each of a plurality of frequency subbands of the signal, performing a frequency transform on the subband to obtain a vector in a modulation domain, and applying a filter to the vector.

21. An apparatus for signal processing according to claim 14, wherein said apparatus comprises means for performing, for each of a plurality of frequency subbands of the plurality of pitch trajectory points, a frequency transform on the subband to obtain a corresponding trajectory vector in a modulation domain.

22. An apparatus for signal processing according to claim 21, wherein said apparatus comprises:

means for calculating a filter in the modulation domain, based on information from at least one of said plurality of trajectory vectors;

means for performing, for each of a plurality of frequency subbands of the signal in the frequency domain, a frequency transform on the subband to obtain a corresponding signal vector in a modulation domain; and means for applying the calculated filter to each of a plurality of the signal vectors.

23. An apparatus for signal processing according to claim 14, wherein said apparatus includes:

means for extracting a timbre corresponding to a time-varying pitch trajectory of the signal, based on information from the processed signal; and means for mapping the extracted timbre to a stationary timbre.

24. An apparatus for signal processing according to claim 14, wherein said apparatus includes means for locating a vibrato component of the signal, based on the result of said analyzing, and wherein said attenuating includes attenuating said vibrato component.

25. An apparatus for signal processing according to claim 14, wherein said apparatus includes means for associating an offset of a stable pitch trajectory of the signal with an onset of a time-varying pitch trajectory of the signal, based on the result of said analyzing.

26. An apparatus for signal processing according to claim 14, wherein said apparatus comprises means for applying an inventory of basis functions to the processed signal to extract at least one instrumental component.

27. An apparatus for processing a signal that includes a vocal component and a non-vocal component, said apparatus comprising:

a calculator configured to calculate a plurality of pitch trajectory points that are based on a measure of harmonic energy of the signal in a frequency domain, wherein said calculator is configured to calculate a plurality of pitch trajectory points by calculating a value of the measure of harmonic energy for each of a plurality of harmonic basis functions, wherein said plurality includes a plurality of points of a first pitch trajectory of the vocal component and a plurality of points of a second pitch trajectory of the non-vocal component;

an analyzer configured to analyze changes in a frequency of said first pitch trajectory over time, wherein said analyzer is further configured to measure a plurality of gradients for each value of the measure of harmonic energy that exceeds a threshold; and an attenuator configured to attenuate energy of the vocal component relative to energy of the non-vocal component, based on a result of said analyzing, to produce a processed signal.

28. An apparatus for signal processing according to claim 27, wherein each harmonic basis function among the plurality of harmonic basis functions corresponds to a different fundamental frequency.

29. An apparatus for signal processing according to claim 27, wherein said calculator is configured to calculate a value of the measure of harmonic energy for each of the plurality of harmonic basis functions by projecting the signal onto a column space of the plurality of harmonic basis functions.

30. An apparatus for signal processing according to claim 27, wherein said attenuating is based on a change in frequency between points of the first pitch trajectory that are adjacent in time.

31. An apparatus for signal processing according to claim 27, wherein said analyzer is configured to detect a difference, in a frequency dimension, between points of the first pitch trajectory that are adjacent in time.

32. An apparatus for signal processing according to claim 27, wherein said analyzer is configured to calculate a difference, in a frequency dimension, between points of the first pitch trajectory that are adjacent in time.

33. An apparatus for signal processing according to claim 27, wherein said attenuator is configured to perform, for each of a plurality of frequency subbands of the signal, a frequency transform on the subband to obtain a vector in a modulation domain, and to apply a filter to the vector.

34. An apparatus for signal processing according to claim 27, wherein said apparatus comprises a transform calculator configured to perform, for each of a plurality of frequency subbands of the plurality of pitch trajectory points, a frequency transform on the subband to obtain a corresponding trajectory vector in a modulation domain.

35. An apparatus for signal processing according to claim 34, wherein said apparatus comprises:

a second calculator configured to calculate a filter in the modulation domain, based on information from at least one of said plurality of trajectory vectors; and a subband transform calculator configured to perform, for each of a plurality of frequency subbands of the signal in the frequency domain, a frequency transform on the subband to obtain a corresponding signal vector in a modulation domain, and wherein said filter is arranged to filter each of a plurality of the signal vectors.

36. An apparatus for signal processing according to claim 27, wherein said apparatus includes a classifier configured to extract a timbre corresponding to a time-varying pitch trajectory of the signal, based on information from the processed signal and to map the extracted timbre to a stationary timbre.

37. An apparatus for signal processing according to claim 27, wherein said apparatus includes a classifier configured to locate a vibrato component of the signal, based on the result of said analyzing, and wherein said attenuator is configured to attenuate said vibrato component.

38. An apparatus for signal processing according to claim 27, wherein said apparatus includes a classifier configured to associate an offset of a stable pitch trajectory of the signal with an onset of a time-varying pitch trajectory of the signal, based on the result of said analyzing.

39. An apparatus for signal processing according to claim 27, wherein said apparatus comprises a classifier configured to apply an inventory of basis functions to the processed signal to extract at least one instrumental component.

40. A non-transitory machine-readable storage medium comprising codes for causing a machine to:

based on a measure of harmonic energy of the signal in a frequency domain, calculate a plurality of pitch trajectory points, wherein said calculating a plurality of pitch trajectory points includes calculating a value of the measure of harmonic energy for each of a plurality of harmonic basis functions, wherein said plurality includes a plurality of points of a first pitch trajectory of the vocal component and a plurality of points of a second pitch trajectory of the non-vocal component analyze changes in a frequency of said first pitch trajectory over time, wherein said analyzing changes comprises measuring a plurality of gradients for each value of the measure of harmonic energy that exceeds a threshold; and based on a result of said analyzing, attenuate energy of the vocal component relative to energy of the non-vocal component to produce a processed signal.

* * * * *